United States Patent [19]

Engel et al.

[11] Patent Number: 5,019,028

[45] Date of Patent: May 28, 1991

[54] METHOD AND APPARATUS FOR PERFORATING AND/OR SEVERING TUBULAR BODIES

[75] Inventors: Adalbert Engel, Drosselweg 4, D-7850 Lörrach; Christoph Engel; Uta-Marie Engel, both of Lörrach, all of Fed. Rep. of Germany

[73] Assignee: Adalbert (Lörrach) Engel, Lörrach, Fed. Rep. of Germany

[21] Appl. No.: 224,213

[22] Filed: Jul. 22, 1988

Related U.S. Application Data

[63] Continuation of Ser. No. 37,095, Apr. 19, 1987, abandoned, which is a continuation of Ser. No. 478,912, Mar. 25, 1983, abandoned.

[30] Foreign Application Priority Data

Apr. 1, 1982 [DE] Fed. Rep. of Germany ..... 3212153

[51] Int. Cl.[5] ..... B26D 3/16; B26D 9/00; B26F 1/24

[52] U.S. Cl. ..... 493/290; 82/47; 82/95; 82/101; 83/16; 83/24; 83/99; 83/660; 83/667; 493/363; 493/341; 493/470; 493/954

[58] Field of Search ..... 83/54, 171, 866, 660, 83/102, 99, 667, 862, 865, 867, 868, 16, 24, 555, 160, 514, 464; 82/84, 86, 92-95, 101, 102, 47; 493/290, 363, 365, 341, 470, 954

[56] References Cited

U.S. PATENT DOCUMENTS

| | | | |
|---|---|---|---|
| 2,272,179 | 2/1942 | Allardt | 82/102 X |
| 3,086,288 | 4/1963 | Balamuth et al. | 30/272 |
| 3,232,298 | 2/1966 | Tomlinson | 83/866 X |
| 3,370,491 | 2/1968 | Cross | 83/54 X |
| 3,620,115 | 11/1971 | Zieg et al. | 83/54 X |
| 3,750,503 | 8/1973 | McMillan | 83/171 X |
| 3,847,044 | 11/1974 | Rudszinat | 83/866 |
| 3,848,929 | 11/1974 | Miller | 83/171 X |
| 3,877,831 | 4/1975 | Maroschak | 83/54 |
| 4,290,330 | 9/1981 | Washio et al. | 83/171 X |
| 4,292,872 | 10/1981 | Brinker | 83/660 |
| 4,319,589 | 3/1982 | Labbe | 83/868 |
| 4,414,783 | 11/1983 | Vincent | 83/171 X |

FOREIGN PATENT DOCUMENTS

| | | |
|---|---|---|
| 2877019 | 6/1973 | Fed. Rep. of Germany . |
| 2623851 | 12/1977 | Fed. Rep. of Germany . |
| 2749894 | 5/1979 | Fed. Rep. of Germany . |
| 1128691 | 10/1968 | United Kingdom . |

*Primary Examiner*—Hein H. Phan
*Attorney, Agent, or Firm*—Peter K. Kontler

[57] ABSTRACT

Tublar workpieces are formed with perforations of desired size and/or shape by repeatedly piercing selected portions of the workpieces by needles, pins or analogous piercing tools. The tools can be stationary while the workpieces roll therealong, or the workpieces can rotate while coming into repeated engagement with one or more sets of orbiting tools. The frequency and the number of penetrations of tools into selected portions of the workpieces are selected with a view to heat the tools as a result of frictional engagement with the material of the workpieces, i.e., as a result of repeated penetration into and extraction from selected portions of a rotating or rotating and rolling and/or axially moving workpiece. This enhances the making of predictable perforations in tubular workpieces, especially workpieces which consist of a synthetic thermoplastic material, such as bobbins for the storage of textile yarns. One or more knives can be provided to subdivide each discrete workpiece or a continuous tubular body into discrete sections of desired length.

44 Claims, 6 Drawing Sheets

Fig. 7
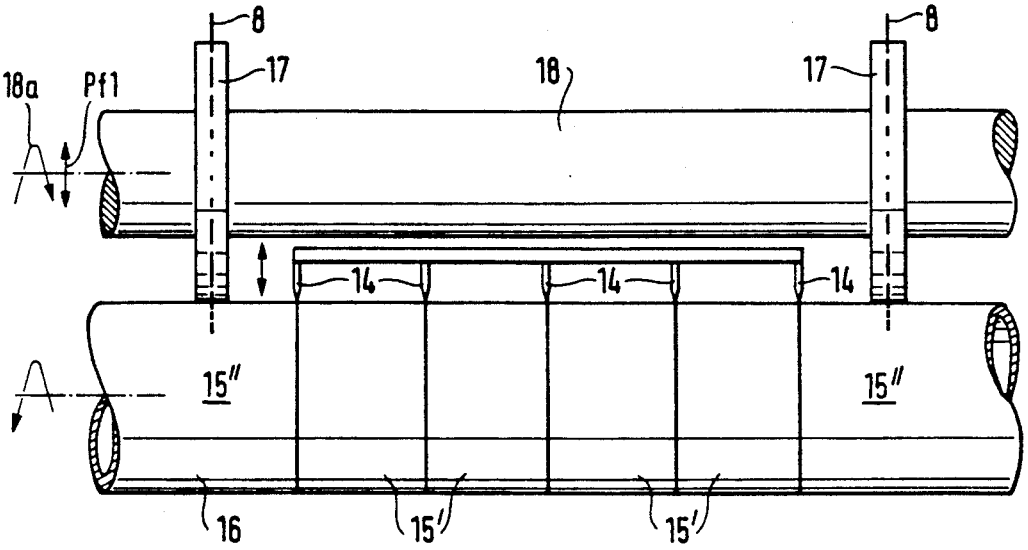
Fig. 9
Fig. 8
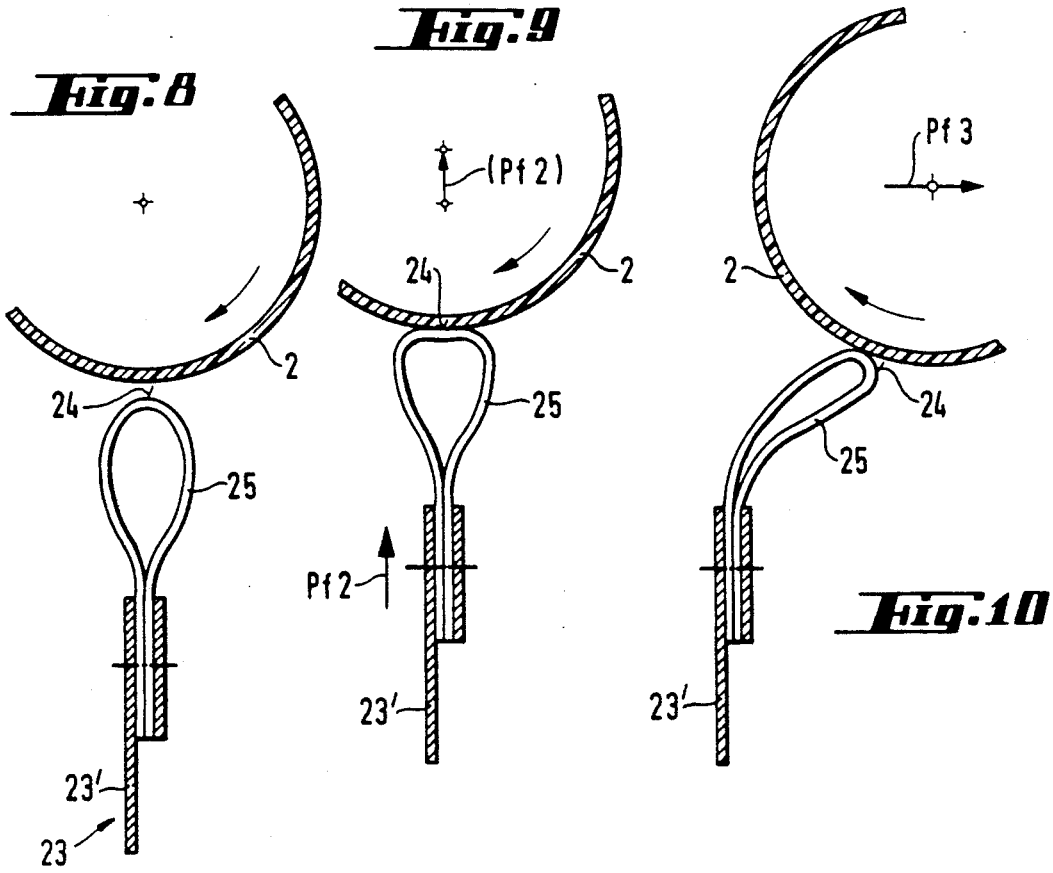
Fig. 10

Fig. 12
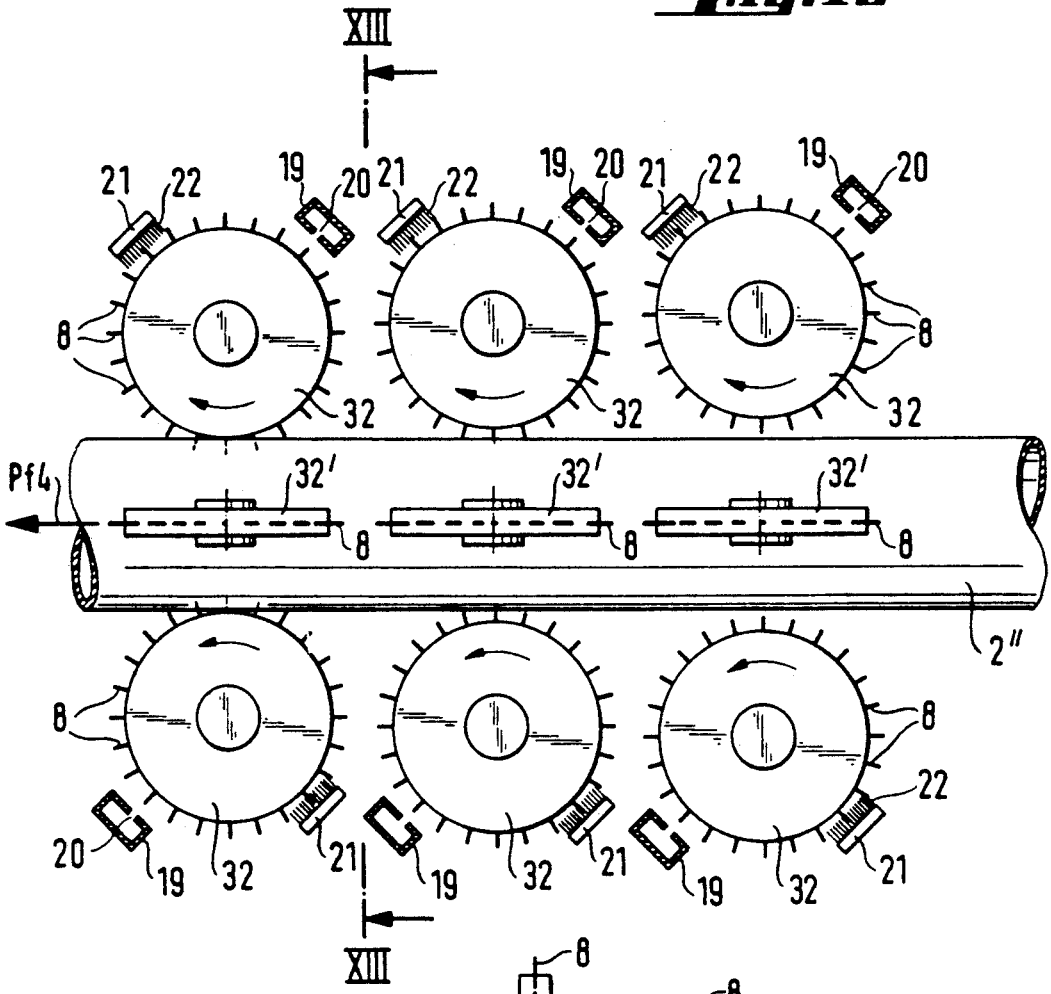
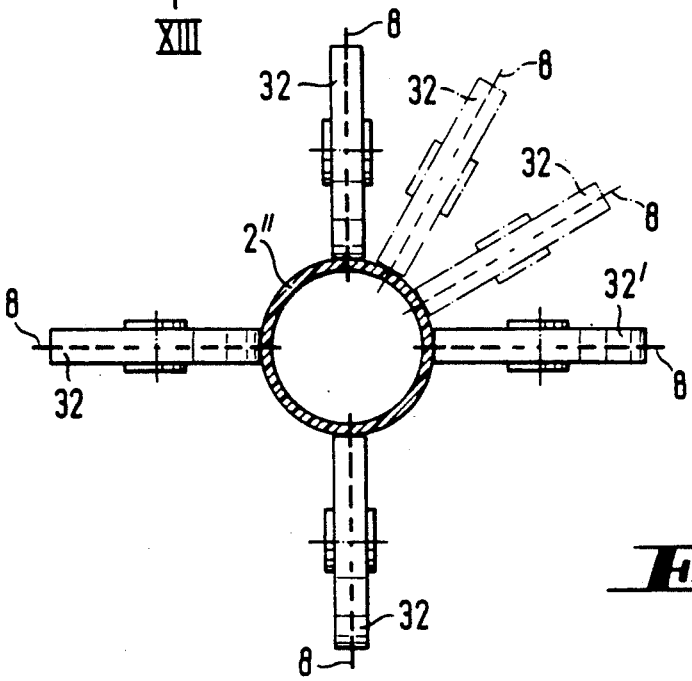
Fig. 13

METHOD AND APPARATUS FOR PERFORATING AND/OR SEVERING TUBULAR BODIES

This application is a continuation, of application Ser. No. 037,095, filed Apr. 9, 1987, now abandoned, which is a continuation of Ser. No. 478,912, filed Mar. 25, 1983, now abandoned.

BACKGROUND OF THE INVENTION

The present invention relates to improvements in a method and in an apparatus for making holes, bores, slits and other forms of perforations or incisions in the walls of tubular bodies, e.g., in the walls of cylindrical commodities which constitute bobbins for storage of textile yarns or the like. More particularly, the invention relates to improvements in a method and apparatus for the making of perforations and/or incisions in the walls of tubular commodities of the type having cylindrical, conical, annular and/or otherwise configurated sections with an axis of rotation. Still more particularly, the invention relates to improvements in a method and apparatus for severing and/or perforating tubular commodities which preferably do, but need not always, consist of a synthetic plastic material, e.g., a synthetic thermoplastic material.

Commonly owned U.S. Pat. No. 4,108,396 granted Aug. 22, 1978 to Adalbert Engel discloses a bobbin which can be used for temporary storage of textile yarns or the like, e.g., for storage of convoluted yarns during contacting of such yarns with a dye. The bobbin is permeable to liquids and, to this end, its wall is formed with numerous holes, slots, bores or like passages for the flow of a fluid from its interior to its exterior and/or vice versa. The bobbin preferably consists of a synthetic thermoplastic material and is preferably deformable in the radial and/or axial direction. The same bobbin can be used with advantage for heat-treatment and/or other treatments of yarns which are convoluted therearound.

It is further known and customary to subdivide an elongated (e.g., continuous) tubular body into shorter sections or discrete commodities by severing the elongated tubular body at regular or irregular intervals in planes which are normal or substantially normal to its axis. For example, such procedure can be resorted to for the mass-production of relatively short or relatively long tubes which are made of cardboard and can serve as cores for convoluted yarns, webs of paper, webs of metallic foil or the like. Analogously, a relatively long elongated tubular body can be subdivided into a succession (e.g., into a single file) of discrete tubes which are used as cores for convoluted sheets of wallpaper or the like. One presently known and often preferred mode of making a continuous tubular body of a synthetic plastic material is blow molding or an analogous technique. Blow molding can involve the making of an endless tubular body or the production of discrete blow molded articles in one or more molds wherein the plastic material is confined from all sides during expansion by air which is blown into the interior of a parison or which is drawn from the mold cavity around the parison. Discrete blow molded articles often require a secondary treatment, for example, cutting away the flash and/or cutting away the bottom wall and/or the top wall so that the finished article is open at one or both axial ends.

It is also known to employ heated needles or like piercing tools for the making of perforations in sheets, foils or the like. This necessitates the use of one or more heaters which consume substantial amounts of energy and contribute to the bulk and initial cost of the perforating apparatus.

OBJECTS AND SUMMARY OF THE INVENTION

An object of the invention is to provide a novel and improved method of perforating and/or at least partially severing tubular commodities in such a way that the energy requirements for the practice of the perforating and/or severing method are but a fraction of energy requirements for the practice of conventional perforating and/or severing methods.

Another object of the invention is to provide a method which can be resorted to for the making of perforations of any one of a wide variety of different sizes and/or shapes in a small area, at a high frequency and with a high degree of reproducibility.

A further object of the invention is to provide a method which can be used for the making of perforations and/or incisions in a wide variety of materials and which ensures that the perforations and/or incisions in each of a short or long series of successively treated commodities will not only approximate but actually match the desired optimum configuration, distribution and/or dimensions.

An additional object of the invention is to provide a method which can be used with particular advantage for the economical making of perforations and/or incisions in tubular workpieces which consist of a synthetic thermoplastic material.

Another object of the invention is to provide a novel and improved apparatus for the practice of the above outlined method.

A further object of the invention is to provide an apparatus which is highly versatile and which can adequately treat a wide variety of differently dimensioned, configurated, produced and/or pretreated workpieces in a small area and with surprisingly low consumption of energy.

An additional object of the invention is to provide the apparatus with novel and improved means for locating and confining tubular commodities during the making of perforations and/or slits in their walls.

Another object of the invention is to provide the apparatus with novel and improved piercing or perforating means.

Still another object of the invention is to provide an apparatus which can be rapidly converted from the treatment of larger-diameter commodities to the treatment of smaller-diameter workpieces or vice versa.

Another object of the invention is to provide an apparatus which can simultaneously treat two or more tubular workpieces.

A further object of the invention is to provide an apparatus which can simultaneously slit as well as perforate one or more tubular commodities, such as bobbins for storage of textile yarns or the like.

Another object of the invention is to provide the apparatus with novel and improved means for ensuring long useful life of piercing and/or severing tools.

A further object of the invention is to provide an apparatus which can be utilized as a superior substitute for many heretofore known types of perforating and/or slitting or severing apparatus.

One feature of the invention resides in the provision of a method of making perforations in selected portions of the walls of tubular workpieces, such as bobbins for textile yarns or the like, with piercing tools in the form of needles, pins, studs, nails or analogous pointed implements. Basically, the method comprises the step of effecting repeated penetration of at least one piercing tool through selected portions of the wall of a workpiece at a frequency and a total number of times which are sufficiently high to raise the temperature of the tool as a result of repeated frictional engagement between the tool and the material of the workpiece during penetration and extraction of the tool. The beneficial results of such automatic heating of the tool or tools while making perforations in the wall of a tubular workpiece will be readily appreciated by bearing in mind that numerous bobbins are made of a synthetic thermoplastic material.

At least some selected locations of the workpiece can be contiguous so that the perforations in their totality can form at least one incision through the wall of the workpiece.

The method can further comprise the steps of rotating the workpiece about its own axis in the course of the penetration effecting step and of orbiting the tool about a second axis so that the tool penetrates into the wall of the workpiece once during each of its orbits. The orbiting step takes place simultaneously with the penetration effecting and workpiece-rotating steps. The circle which is described by the tip of the piercing tool in the course of the orbiting step intersects the periphery of the rotating workpiece to a desired degree, i.e., to a degree (which can be varied and) which determines the extent of penetration of the tool into the wall of the rotating workpiece during each orbit of the tool. The rotating step preferably comprises rotating the workpiece in a first direction, and the orbiting step preferably comprises orbiting the tool in a second direction counter to the first direction.

The method can further comprise the step of orbiting at least one additional piercing tool about a third axis so that the additional tool penetrates into the wall of the rotating workpiece once during each of its orbits. The orbiting of the additional tool also takes place in the course of the penetration effecting step. The second and third axes preferably are but need not be at least substantially parallel to the axis of the rotating workpiece.

The rotating step can take place in automatic response to orbiting of one or more piercing tools about one or more axes other than the axis of the rotating workpiece, i.e., the workpiece can be rotated about its own axis as a result of orbiting of one or more piercing tools and the ensuing puncturing of the wall of the workpiece by the tool or tools.

The method can further comprise the step of regulating the temperature of the tool or tools in the course of the penetration effecting step. Such temperature regulating step can comprise contacting the tool with a gaseous fluid at predetermined intervals in the course of the penetration effecting step, e.g., once during each orbit of the tool or tools. Alternatively or in addition to such pneumatic temperature regulating step, the temperature regulating step can comprise hydraulically cooling the tool, preferably while the tool is out of contact with the workpiece, i.e., contacting the tool with a liquid coolant. For example, the liquid coolant can be atomized prior to spraying the atomized coolant onto the tool while the tool is out of contact with the workpiece. The liquid coolant can be oil or another lubricant; the temperature regulating step by resorting to lubricant can include establishing an exchange of heat between the tool or tools and droplets of the lubricant. The liquid coolant can be applied to the tool or tools by one or more rotary and/or stationary brushes.

The workpiece can form part of an elongated tubular body whereon the selected portions are contiguous and extend circumferentially of such body so that the perforations in their entirety form a circumferentially complete incision in the elongated body, i.e., the method can be used to subdivide the elongated body into a succession of discrete tubular sections (e.g., bobbins), preferably while the elongated body rotates about its own axis. The penetration effecting step can comprise perforating additional selected portions of the elongated body, i.e., portions other than the aforementioned contiguous portions so that the discrete tubular sections can be formed with perforations simultaneously with their separation from the elongated body. The latter can be formed in an extruding, blow molding or other machine which is suitable for the production of a continuous tubular body, preferably a body which is made of a synthetic plastic material.

Another feature of the invention resides in the provision of an apparatus for making perforations in selected portions of the walls of tubular workpieces, such as synthetic thermoplastic bobbins for textile yarns or the like. The apparatus comprises perforating means including at least one needle, pin or an analogous piercing tool, and means for effecting repeated penetration of the tool into the selected portions of a workpiece at a frequency and a total number of times which are sufficiently high to raise the temperature of the piercing tool as a result of repeated frictional engagement between the tool and the material of the workpiece during penetration and extraction of the tool. The perforating means preferably comprises a plurality of identical or dissimilar piercing tools and at least one stationary or mobile holder for such tools. The aforementioned perforation effecting means can comprise means for effecting a relative movement between the holder and the workpiece, i.e., for moving the workpiece relative to a stationary holder, for moving the holder relative to a stationary workpiece, or for moving the holder relative to the workpiece while the workpiece also performs at least one movement, preferably about its own axis, or a combined sidewise and rolling movement.

The apparatus preferably further comprises means defining a treating station where the workpiece is pierced by the tool or tools in the course of the aforementioned relative movement. In accordance with one presently preferred embodiment of the invention, the station defining means can comprise a plurality of rings or otherwise configurated rotary confining elements which engage the periphery of the workpiece so that the latter is rotatable about its own axis.

The holder can include a rotor (e.g., a cylinder or a series of coaxial cylinders) whose axis is at least substantially parallel to the axis of the workpiece at the aforementioned station. Such apparatus can further comprise a single lever, a system of levers and links, or other suitable means for moving the holder to and from an operative position in which the tool or tools on the holder can pierce the wall of the workpiece which is confined at the aforementioned station. The moving means can be designed to disengage the tool or tools from the workpiece upon completion of the perforating operation and/or to select the extent to which the tip(s) of the tool(s) penetrate into the wall of the workpiece at the aforementioned station. The tool or tools may but need not be profiled, i.e., they may have predetermined (circular, star-shaped, oval, polygonal or other suitable cross-sectional) outlines if the tool or tools are to form perforations of one or more predetermined shapes.

The apparatus preferably further comprises confining elements which define a treating station for the workpiece that is about to be provided with perforations. The confining elements are preferably adjustable so as to provide at the treating station room for larger- or smaller-diameter workpieces. Also, the confining elements can be exchanged to ensure that each thereof can accurately follow the profile of a workpiece, e.g., a workpiece having larger-diameter portions alternating with smaller-diameter portions, as considered in the axial direction of the workpiece.

The axial length of the rotary holder which carries piercing tools can at least match the axial length of that portion of a workpiece which is to be provided with perforations and/or slits.

Still further, the apparatus can comprise means for severing the workpiece at the treating station. Such severing means can comprise one or more rotary and/or elongated (preferably pivotable) knives which are movable into and from severing engagement with the workpiece at the treating station. At least one of the elements which define the treating station is preferably assembled of several coaxial portions which are spaced apart from one another to provide room for the knife or knives of the severing means. Such knife or knives can be mounted on the means for moving the rotary holder or holders for piercing tools to and from an operative position. If the severing means comprises several knives, the cutting edges of the knives can be staggered so that they engage the workpiece at the treating station at timely spaced intervals. This reduces the likelihood of excessive deformation and/or excessive braking of the workpiece as a result of engagement with the cutting edges of plural knives.

The apparatus preferably further comprises means for regulating the temperature of piercing tools prior to and/or during treatment of a workpiece. Such temperature regulating means can comprise one or more means for directing a gaseous and/or liquid coolant against the tools, either while the tools actually penetrate into a workpiece or while the tools are out of contact with the workpiece. The liquid coolant may but need not be oil, and the coolant applying means can comprise means for atomizing a liquid coolant and for thereupon spraying atomized liquid coolant against the tools, e.g., against the tools at the periphery of a rotary holder.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 7 is a fragmentary front elevational view of a third apparatus wherein the piercing tools need not perforate but invariably rotate a tubular workpiece and wherein such workpiece is subdivided into several shorter tubular sections;

FIG. 8 is a fragmentary sectional view of a workpiece and of an ejector which is about to dislodge the workpiece from the treating station;

FIG. 9 illustrates the structure of FIG. 8, with the workpiece in a partly ejected position;

FIG. 10 illustrates the structure of FIGS. 8 and 9, with the workpiece shown during a further stage of ejection from the treating station;

FIG. 12 is a fragmentary partly elevational and partly sectional view of a fifth apparatus with a large number of rotary holders for sets of piercing tools, the holders being rotatable about axes which extend at right angles to the axis of the tubular workpiece; and FIG. 13 is a sectional view as seen in the direction of arrows from the line XIII—XIII of FIG. 12.

DESCRIPTION OF THE PREFERRED EMBODIMENTS

Figure 1:
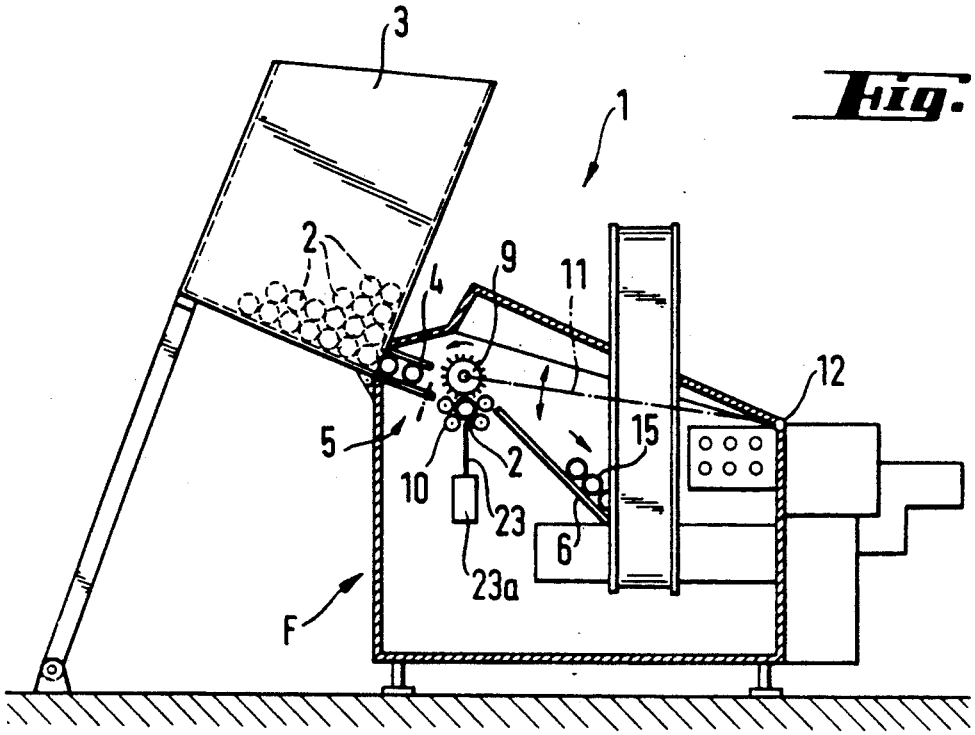
FIG. 1 is a partly elevational and partly vertical sectional view of an apparatus which embodies one form of the invention and comprises a single composite rotary holder for three sets of piercing tools.
Figure 2:
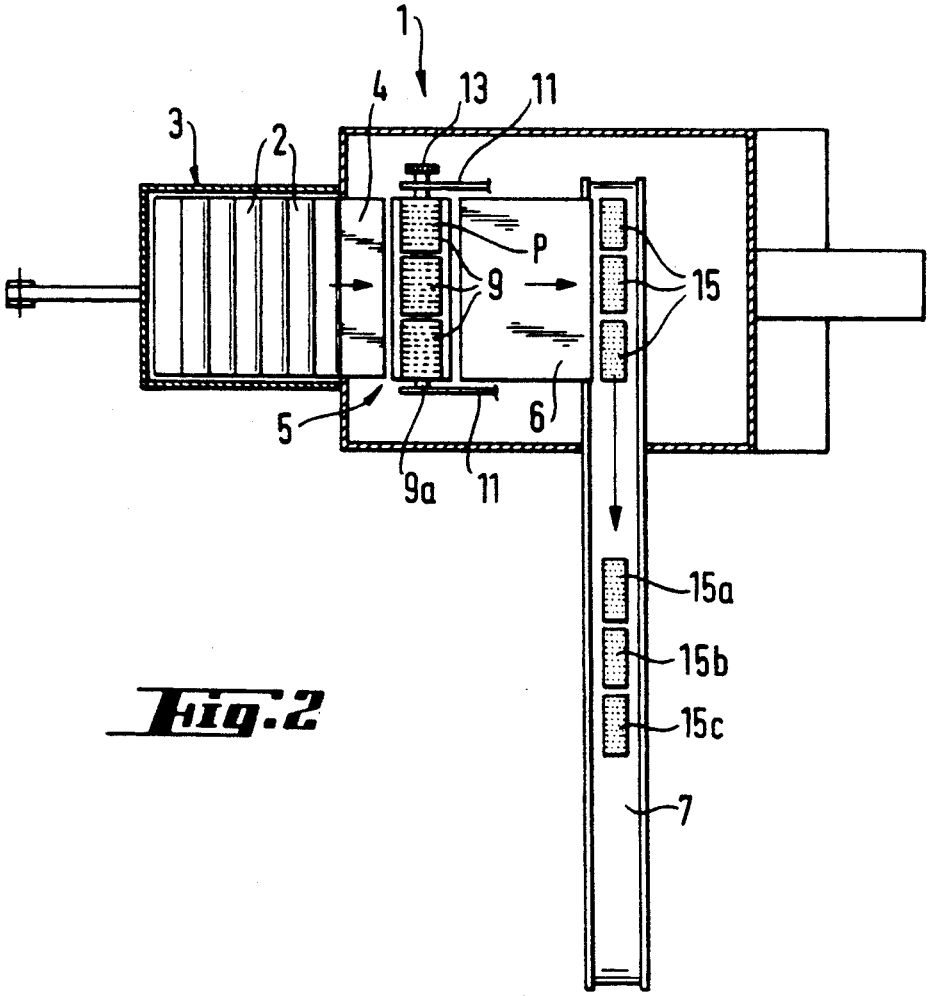
FIG. 2 is a partial plan and partial horizontal sectional view of the apparatus which is shown in FIG. 1.
Figure 3:
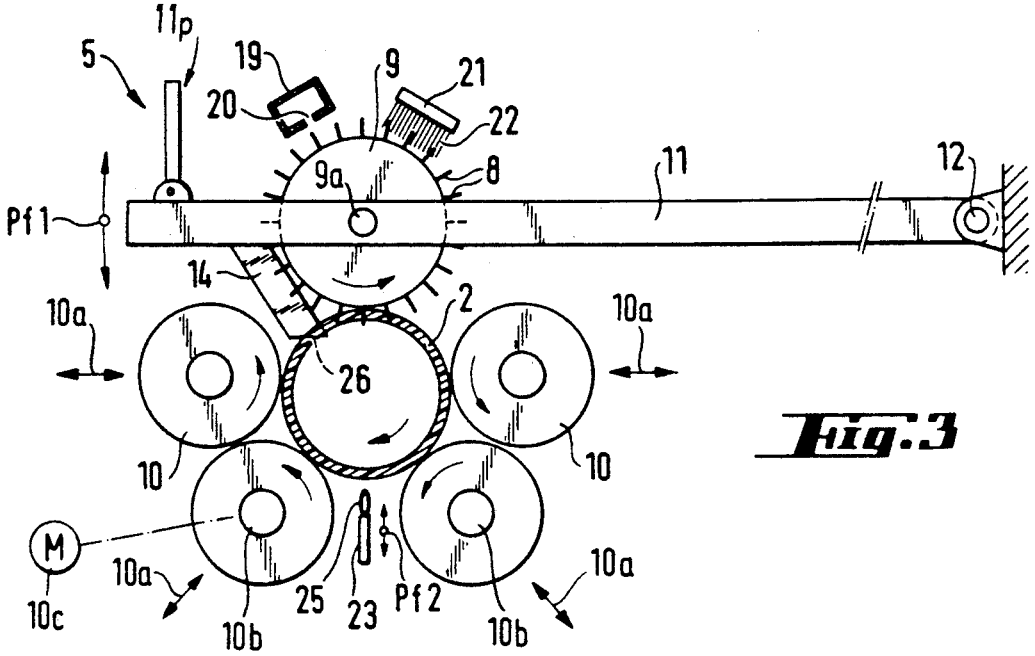
FIG. 3 is an enlarged view of a detail in the apparatus of FIG. 1 with the workpiece, which is in the process of being provided with perforations, shown in a sectional view.

Referring first to FIGS. 1, 2 and 3, there is shown an apparatus 1 which is constructed and assembled to perforate successive tubular workpieces 2 which are caused to advance seriatim to a treating or perforating station 5 best shown in FIG. 3. Each workpiece 2 can constitute a tubular bobbin for temporary storage of yarns or the like, e.g., a bobbin of the type shown in FIG. 1, 2 or 3 of the aforementioned U.S. Pat. No. 4,108,396 to Engel. As indicated in FIG. 3, each of the bobbins 2 can consist of a synthetic plastic material, preferably a thermoplastic substance.

FIGS. 1 and 2 show a magazine 3 for a supply of parallel workpieces 2 each having a predetermined length, namely, the desired ultimate length. However, it is equally within the purview of the invention to place the apparatus 1 downstream of a machine which extrudes, blows or otherwise forms a continuous tubular body which is to be subdivided into workpieces 2 or analogous tubular commodities of predetermined length whereby the improved apparatus carries out the subdividing operation and/or the making of perforations in each of the workpieces 2, either prior or subsequent to subdivision of the tubular body into discrete workpieces. The piercing tools 8 of the apparatus 1 can be used to provide the tubular body with incisions (e.g., to subdivide the tubular body into discrete workpieces 2 and/or to perforate the tubular body and/or the individual workpieces). For example, if the improved apparatus is placed downstream of a blow molding machine wherein tubular parisons are converted into discrete tubular workpieces, the apparatus 1 can be used to remove the flash and/or to provide successive blow molded articles with transverse cuts in planes which are normal to the axes of the articles, e.g., to remove the bottom walls of substantially bottle-shaped blow molded articles. It is assumed that the workpieces 2 in the magazine 3 are obtained by subdividing a continuous tubular body which has been formed in an extruding, blow molding or like machine of any known design.

The magazine 3 for a supply of parallel workpieces 2 is attached to or forms part of a stationary or wheel-mounted frame F and has a downwardly sloping outlet 4 which discharges successive workpieces 2 into the perforating or treating station 5 defined by a set of parallel horizontal rotary locating and confining elements 10. Finished (perforated) workpieces or bobbins 15 are expelled from the station 5 by a reciprocable ejector 23 and roll along a chute 6 which delivers the finished workpieces 15 onto the upper reach of an endless belt or chain conveyor 7. The outlet 4 of the magazine 3 and the chute 6 are disposed at the opposite sides of the treating station 5.

The station 5 further accommodates an elongated rotary cylindrical holder 9 which constitutes or includes a rotor and carries a set of radially outwardly extending piercing tools 8 in the form of needles or the like. The axis of rotation of the holder 9 is horizontal and is parallel to the axis of the workpiece 2 at the station 5 as well as to the axes of the rotary locating and confining elements 10 which define the station 5 and form a nest for the workpiece which is about to be, and which is in the process of being, treated at the station 5. The elements 10 can constitute rings, sleeves, cylinders or combinations of such components. FIG. 3 shows that, when the holder or rotor 9 for the piercing tools 8 is held in the illustrated operative position, the circular path of orbital movement of the tips of piercing tools 8 intersects the periphery of the workpiece 2 at the station 5 so that, sooner or later, the tools 8 are caused to penetrate into and thus perforate the cylindrical wall of the workpiece 2 even if the latter consists of a material which is deformable in the axial and/or radial direction. The means for moving the holder 9 to and from the operative position of FIG. 3 (substantially radially of the workpiece at the station 5) includes at least one elongated one-armed lever 11 which carries the shaft 9*a* of the holder 9 and is pivotally secured to the frame F by a pin 12. FIG. 2 shows a discrete lever 11 for each end portion of the shaft 9*a*. The directions in which the lever or levers 11 are pivotable to move the holder 9 to or from the operative position of FIG. 3 are indicated by the double-headed arrow Pf1. The means for pivoting the lever or levers 11 comprises one or more eccentrics, not shown, or one or more fluid-operated motors (e.g., double-acting pneumatic cylinder and piston units one of which is indicated at 11*p*). When the treatment of the workpiece 2 at the station 5 is completed, the lever 11 is pivoted in a clockwise direction, as viewed in FIG. 3, either by hand or automatically, so as to provide room for expulsion of the finished workpiece 15 onto the chute 6 in response to upward movement (arrow Pf2) of the ejector 23 which, in the apparatus 1, is installed between the two lower rotary confining elements 10 at the six o'clock position of the workpiece 2 at the station 5. The mechanism 23*a* which moves the ejector 23 up and down (in the directions indicated by the arrow Pf2) can be coupled to or may constitute the mechanism for moving the lever or levers 11 and the holder 9 to and from the operative position of FIG. 3. The lever or levers 11 can also serve as a means for selecting the extent to which the piercing tools 8 on the holder 9 penetrate into and through the wall of the workpiece 2 at the station 5 when the holder 9 is held in the operative position. To this end, the frame F can carry a suitable scale and one of the levers 11, or a part which shares the movements of such levers, can be provided with a pointer which cooperates with the scale to indicate the angular position of the lever or levers 11 and hence the level of the shaft 9*a*, i.e., the extent to which the piercing tools 8 penetrate into the wall of the workpiece 2 at the station 5 when the apparatus 1 of FIGS. 1 to 3 is in actual use. The lever or levers 11 return the holder 9 to the operative position of FIG. 3 upon completed expulsion of a freshly finished workpiece 15 and subsequent admission of a fresh workpiece 2 from the interior of the magazine 3 into the station 5.

The piercing tools 8 can have any one of a wide variety of different profiles, e.g., a circular, oval, star-shaped, polygonal or other cross-sectional outline, depending on the desired configuration of perforations which are to be formed in the walls of the workpieces 2. Such perforations are indicated at P in FIG. 2, and each such perforation can constitute a hole or slot extending all the way through the wall of the respective finished workpiece 15.

The apparatus 1 can be converted for the treatment of larger-diameter or smaller-diameter workpieces 2 by the simple expedient of adjusting the positions of the rotary confining elements 10 in directions indicated by the double-headed arrows 10*a* and by properly selecting the level of the shaft 9*a* in the operative position of the holder 9 for piercing tools 8. The exact construction of the bearings (mounted in the two side walls of the frame F) for the shafts 10*b* of the rotary elements 10 forms no part of the present invention; the end portions of the shafts 10*b* can be installed in blocks which are movable in the respective sidewalls of frame F between any desired number of different positions and can be arrested in each selected position to define a station 5 which can snugly accommodate a large-diameter workpiece 2, a small-diameter workpiece or a workpiece having an intermediate diameter. The adjustment of the holder 9 merely involves a movement of the levers 11 to different angular positions, i.e., clockwise or counterclockwise, as viewed in FIG. 3.

The means for effecting repeated penetration of piercing tools 8 into selected portions of the workpiece 2 at the station 5 comprises a drive for the shaft 9*a* of the holder 9. Such drive includes a gear 13 which can form part of a gear train receiving torque from a variable-speed electric motor or another suitable prime mover, a sprocket wheel which is driven by a chain, a toothed pulley which is driven by a toothed belt, or any other means for rotating the holder 9 in a predictable way so that the piercing tools 8 repeatedly penetrate into selected portions of the wall of the workpiece 2 at the station 5. The confining elements 10 can rotate in response to rotation of the workpiece 2 at the station 5, and the latter can rotate as a result of repeated engagement with the piercing tools 8, i.e., the drive including the gear 13 can serve to rotate the holder 9 in a counterclockwise direction, as viewed in FIG. 3, to rotate the workpiece 2 at the station 5 in a clockwise direction through the medium of the holder 9, and to rotate the elements 10 in a counterclockwise direction through the medium of the workpiece 2. Of course, it is equally within the purview of the invention to provide additional drive means (see the motor 10*c* in FIG. 3) for the rotary elements 10, to provide additional drive means for the workpiece 2 at the station 5, to provide drive means only for the workpiece 2 at the station 5, to provide drive means 10*c* only for the rotary elements 10, or to provide discrete or unitary drive means for the holder 9, workpiece 2 at the station 5 and the rotary elements 10. The motor 10*c* is connected with the end portion of the corresponding shaft 10*b* at the outer side of the respective side wall of the frame F. It has been found that the perforating operation is quite satisfactory if the means for effecting repeated penetration of piercing tools 8 into the wall of the workpiece 2 at the station 5 merely includes a drive for the holder 9, i.e., if the rotary elements 10 merely constitute idlers which are set in rotary motion as a result of frictional engagement with the workpiece 2 at the station 5 as soon as the latter begins to rotate in response to engagement with the orbiting tools 8.

FIG. 2 shows that the axial length of the holder 9 matches or approximates the axial length of a workpiece 2 in the magazine 3. The length of the holder 9 can be reduced if the workpieces 2 need not be perforated all the way from the one to the other axial end thereof. FIG. 2 further shows that each finished workpiece 15 consists of three coaxial sections 15*a*, 15*b*, 15*c* which are obtained in response to severing of the workpiece 2 at the station 5 by two knives 14 which are preferably mounted on the lever or levers 11 so that they are lifted together with the holder 9 when a freshly finished workpiece 15 (consisting of sections 15*a*, 15*b*, 15*c*) is to be expelled from the station 5. The cutting edge 26 of each knife 14 preferably makes an acute angle with the tangent to the adjacent portion of the peripheral surface of the workpiece 2 at the station 5; this insures gradual severing of the workpiece 2 in response to movement of the holder 9 to its operative position. The positions of the cutting edges 26 are preferably selected in such a way that the knives 14 are disengaged from a finished workpiece 15 before the holder 9 ceases to rotate the respective sections 15*a*–15*c* through the medium of its tools 8 and also that the tools 8 begin to rotate a freshly admitted workpiece 2 at the station 5 before the cutting edges 26 of the two knives 14 move into engagement with the wall of the workpiece. Such mode of mounting the knives 14 on the levers 11 ensures gradual penetration of cutting edges 26 into the material of the workpiece 2 at the station 5 as well as unobstructed and smooth retraction of the knives from the circumferentially complete slots between the sections 15*a*, 15*b* and 15*b*, 15*c*, of a finished workpiece 15. Convenient and unobstructed extraction of the knives 14 from such slots is ensured or is much more likely if the sections 15*a* to 15*c* at the station 5 rotate during extraction of the knives.

If desired, the cutting edge 26 of one of the knives 14 can be staggered with reference to the cutting edge of the other knife so that one of the cutting edges begins to penetrate into the wall of the workpiece 2 at the station 5 ahead of the other cutting edge. Such staggering of the cutting edges 26 relative to each other reduces the braking action of the knives 14 upon the rotating workpiece 2 at the station 5 and reduces the likelihood of excessive deformation of the wall of the workpiece as a result of simultaneous engagement with the cutting edges of several knives. Staggering of the cutting edges 26 is especially desirable if the workpiece 2 at the station 5 is relatively short and/or if the workpiece at such station is to be subdivided into relatively short sections.

Still further, extraction of knives 14 from the slots between the neighboring sections 15*a* to 15*c* of a finished workpiece 15 at the station 5 renders it possible to remove burrs, shavings and like fragments of the material of a workpiece 2 which became separated from the sections 15*a* to 15*c* during severing of the workpiece at the station 5 simultaneously with retraction of the knives 14 as a result of pivoting of the levers 11 in a clockwise direction, as viewed in FIG. 3.

Still another advantage of the illustrated mounting of knives 14 and the inclination of their cutting edges 26 relative to the peripheral surface of the workpiece 2 at the station 5 is that the cutting edges are automatically sharpened as a result of contact with the material of the rotating sections 15*a* to 15*c* in the course of the perforating operation as well as during extraction of the knives 14 from the slots between the sections 15*a*, 15*b* and 15*b*, 15*c*. In other words, the just discussed mounting of the knives 14 ensures a more or less pronounced self-sharpening action upon the cutting edges 26 which reduces the maintenance cost and the number and duration of down times of the improved apparatus.

It is clear that the number of knives 14 can be reduced to one or increased to three or more, depending upon the number of sections which a workpiece 2 is to yield during treatment at the station 5. It is also possible to detachably and/or adjustably secure the knife or knives 14 to the lever or levers 11 so that the knife or knives can be moved to and from operative positions (i.e., that the knives can be either pivoted, retracted or completely detached so as to be out of the way if a workpiece 2 need not be subdivided into two or more sections) and/or that the positions of the knife or knives can be adjusted, when necessary, in order to compensate for wear as a result of severing of successive workpieces 2 and prolonged contact with the material of the sections.

At least that confining element 10 which is immediately or closely adjacent to the knives 14 on the levers 11 is preferably assembled of several coaxial portions (not unlike the coaxial portions of the holder 9 shown in FIG. 2), and each of the knives 14 is preferably disposed between two coaxial portions of the neighboring element 10. This is advisable (and often necessary) if the apparatus 1 embodying the structure of FIG. 3 is to be converted for the treatment of relatively small-diameter workpieces 2 so that the leftmost confining element 10 must be moved in a direction to the right, as viewed in FIG. 3, and the levers 11 must move the knives 14 to a level below that which is shown in FIG. 3. In the absence of spaces between coaxial portions of the leftmost confining element 10, the knives 14 could not descend all the way to a level which is needed in order to ensure adequate severing of a small-diameter workpiece 2.

An important advantage of the improved apparatus is that it allows for the making of perforations in the wall of a workpiece 2 with heated piercing tools 8 even though such tools need not be preheated because the heating takes place in automatic response to repeated penetration of the tools 8 into selected portions of the wall of the workpiece at the station 5. All that is necessary is to select the total number of penetrations of tools 8 into selected portions of the wall of a workpiece at the station 5, as well as the frequency of such penetrations, with a view to ensure that the temperature of the tools is raised to the desired value as a result of repeated frictional engagement between the tools and the material of the workpiece during penetration and extraction of the tools. The workpiece 2 at the station 5 is driven by the orbiting tools 8 on the rotating holder 9 with a very high degree of predictability so that one and the same piercing tool or different piercing tools can repeatedly penetrate into selected portions of the wall of the workpiece and such repeated penetration results in desirable heating of the tools. If the material of the workpieces 2 is a synthetic thermoplastic substance, relatively thin piercing tools can be employed for the making of relatively large perforations having a predictable shape as a result of rapid heating of the tools in response to repeated penetration of the tools into selected portions of the wall of the workpiece. Thus, a tool which normally would merely penetrate through but would fail to make a perforation in the wall of a thermoplastic workpiece can be used for the making of perforations which remain open upon completion of the perforating operation on a workpiece at the station 5. In fact, only such treatment of a thermoplastic workpiece actually allows for the making of permanent perforations in the wall of the workpiece because, and especially if the material of the workpiece is elastically deformable, the absence of heating would merely result in the making of a temporary hole which would close immediately upon extraction of the tool. Absence of the need for discrete heating means for the tools 8 simplifies the construction of the apparatus and greatly reduces its energy requirements. Furthermore, the absence of such heating means eliminates the likelihood of overheating of the piercing tools while the apparatus is idle.

As mentioned above, the piercing tools 8 which extend from the periphery of the holder 9 orbit in a counterclockwise direction, as viewed in FIG. 3, while the workpiece 2 in the nest which is defined by the rotary confining elements 10 rotates in a clockwise direction. Thus, the manner in which the holder 9 rotates the workpiece 2 (which, in turn, can rotate the confining elements 10) is analogous to that in which a driver gear transmits torque to a second gear whose teeth mesh with the teeth of the driver gear. Such mode of torque transmission takes place without slippage so that the piercing tools 8 can repeatedly penetrate into selected portions of the wall of the workpiece 2 with a high degree of predictability. As also mentioned above, the degree of penetration of tools 8 into the wall of the workpiece 2 at the station 5 will depend on the extent to which the circle defined by the orbiting tips of the piercing tools 8 intersects the periphery of the workpiece 2 at the station 5, i.e., on the selected level of the shaft 9*a* for the holder 9 above the rotary elements 10. It is not important that one and the same piercing tool 8 invariably penetrate into a given selected portion of the wall of the workpiece 2 which is surrounded by the rotary elements 10; all that counts is to ensure that each selected portion of the wall is punctured a sufficient number of times so as to ensure the making of a predictable perforation as a result of repeated contact with one and the same tool or with different tools.

It can happen that the heating of piercing tools 8 as a result of repeated penetration into the material of the workpiece 2 at the station 5 is excessive. In order to enhance the predictability of the perforating operation, the apparatus of FIGS. 1 to 3 can be further provided with suitable means for regulating the temperature of the tools 8 in the course of each perforating operation. Such regulating means can include hydraulic and/or pneumatic cooling means for the tools 8. Furthermore, the just mentioned temperature regulating means can be used to ensure that the temperature of each piercing tool 8 matches or approximates an optimum temperature prior to the making of perforations in a workpiece 2 at the station 5. Thus, if the number of revolutions of the holder 9 during treatment of a workpiece in the nest defined by the confining rotary elements 10 is known, and if the frequency of penetration of tools 8 into the workpiece in such nest is also known, the heating of the tools during treatment of the workpiece is highly predictable if the temperature of all tools matches a given value prior to start of the perforating operation.

FIG. 3 shows a channel or manifold 19 Which is provided with a continuous slot 20 or with a series of discrete narrower slots or orifices serving to discharge a gaseous coolant (e.g., air) which is supplied by an accumulator, by a blower or any other readily available source and is adjacent to that portion of the path of orbital movement of the tools 8 which is remote from the station 5. The manifold 19 extends in parallelism with the axis of the holder 9 and can be mounted on the lever or levers 11 so that the spacing between the orifice or orifices 20 and the path of orbital movement of the tips of tools 8 remains unchanged irrespective of the angular positions of the levers 11. It is clear that the manifold 19 can receive a liquid coolant and the orifice or orifices 20 can be designed to atomize the liquid coolant so that the orbiting tools 8 are cooled by a spray of atomized liquid. Such cooling action can precede the actual perforating operation or it can continue during the entire perforating operation or during a certain stage or certain stages of such operation, depending on the desired temperature of tools 8 which come into repeated frictional engagement with the material of the workpiece 2 at the station 5.

FIG. 3 further shows that, in lieu of or in addition to the manifold 19, the means for regulating the temperature of the piercing tools 8 can comprise a brush 22 which is mounted on a hollow carrier 21 and whose bristles extend into the path of movement of the tips of or entire orbiting tools 8. The bristles of the brush 22 can apply droplets of a liquid coolant, e.g., oil or another lubricant, to the tools 8 at a location which is spaced apart from the station 5. The carrier 21 can be mounted on the lever or levers 11 for the shaft 9*a* of the holder 9.

FIG. 3 shows a single ejector 23 because the apparatus 1 is assumed to be used for the treatment of small- or medium-diameter tubular workpieces. The ejector 23 is installed opposite the locus of engagement between the tools 8 and knives 14 on the one hand and the workpiece 2 at the station 5 on the other hand. The ejector 23 of FIG. 3 can constitute the foremost one of a row of several (e.g., three) ejectors each of which can be designed to move upwardly when the holder 9 is lifted above and away from the operative position of FIG. 3 to thus transfer a freshly formed group of three coaxial sections 15*a* to 15*c* from the station 5 onto the chute 6.

An ejector 23 is shown in greater detail in FIGS. 8 to 10. As mentioned above, the mechanism 23*a* for raising and lowering this ejector is preferably connected with the lever(s) 11 or with the means for pivoting the lever(s) 11 in the directions indicated by the arrow Pf1. In fact, the mechanism 23*a* preferably constitutes a linkage which couples the ejector 23 directly with the lever or levers 11. Alternatively, the means for raising or lowering the ejector 23 can include a drive, not specifically shown, whose operation is synchronized with the operation of the drive (also not specifically shown) for pivoting the lever(s) 11 so as to move the holder 9 of piercing tools 8 to and from the operative position.

In the embodiment of FIGS. 8 to 10, the ejector 23 includes an elongated strip-shaped support 23' for a deformable hollow looped work-contacting and lifting member 25 whose upper end portion or bight 24 is preferably closely adjacent to but out of contact with the peripheral surface of the workpiece 2 at the station 5 at the time when the lever or levers 11 maintain the holder 9 in the operative position. The support 23' extends in parallelism with the axes of the rotary elements 10 at the station 5, and the lifting member 25 may be an elongated one-piece component or it may comprise a series of successive portions each having a bight below the lowermost portion of the peripheral surface of the workpiece 2 at the station 5. For example, the lifting member 25 can consist of an elastomeric material so that this member can readily flex in response to lifting of the support 23', first to the position of FIG. 9 (by moving the support 23' in the direction of arrow Pf2) and thereupon to the position of FIG. 10 (provided that the level of the support 23' in FIG. 10 is above the level of such support in FIG. 9). The provision of a deformable and preferably elastic lifting member 25 is desirable and advantageous because such member is highly unlikely to damage the finished workpieces 15 each of which includes several sections (15*a* to 15*c*). Once the finished workpiece 15 has been lifted to the position of FIG. 9 (with attendant minor or even pronounced deformation of the lifting member 25 or of the end portion 24 of the lifting member), the workpiece rolls over the right-hand rotary confining element 10 and descends onto the chute 6. Such rolling over the top right-hand confining element 10 can be promoted or facilitated by directed elasticity of the member 25, i.e., by designing and mounting the member 25 in such a way that its end portion 24 tends to flex in a direction to the right, as viewed in FIG. 9, namely, toward the position of FIG. 10. Alternatively or in addition to such design of the lifting member 25, the apparatus 1 can be equipped with one or more air discharging nozzles which are connected to a plenum chamber in response to lifting of the support 23' to the level of FIG. 9 so that streams of air issuing from such nozzles promote the rolling of freshly finished sections 15*a* to 15*c* from the station 5 onto the chute 6. The direction of movement of a set of sections 15*a* to 15*c* from the station 5 toward the top of the chute 6 is indicated in FIG. 10 by a horizontal arrow Pf3. The lifting member 25 preferably remains in the raised position of FIG. 9 at least during the interval which is required by the freshly formed set of sections 15*a* to 15*c* to roll over the upper right-hand rotary confining element 10 of FIG. 3 and onto the downwardly sloping upper side of the chute 6. This ensures that the sections 15*a* to 15*c* cannot drop back onto the two lower rotary members 10 so that the station 5 is invariably free to receive a fresh workpiece 2 from the outlet 4 of the magazine 3.

Figure 4:
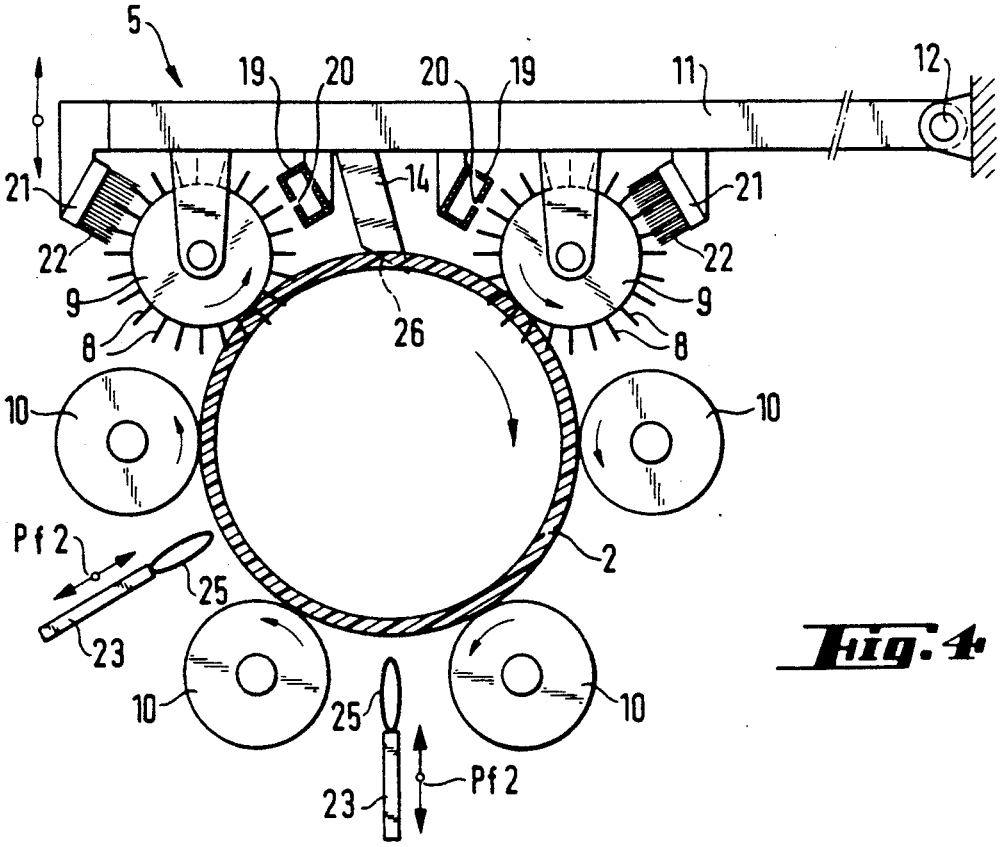
FIG. 4 is a similar view of a detail in a second apparatus with two discrete rotary holders for sets of piercing tools and with a pair of ejectors for treated workpieces.

FIG. 4 shows a portion of a modified apparatus which can be used with advantage for the making of perforations in selected portions of cylindrical walls of large-diameter workpieces 2 or analogous tubular commodities. In this embodiment of the apparatus, the perforating or treating station 5 is again defined by four confining elements 10 which are rotated in response to rotation of the workpiece 2. The lever or levers 11 carry two spaced-apart rotary holders 9 for discrete sets of radially extending piercing tools 8. The knife or knives 14 are mounted on the lever(s) 11 in the space between the two holders 9, and the inclination of their cutting edges 26 with reference to the peripheral surface of the bobbin 2 at the station 5 is preferably identical to that of the cutting edge 26 shown in FIG. 3. The lever or levers 11 further carry two manifolds 19 and two brush carriers 21, one for each of the holders 9.

The apparatus which embodies the structure of FIG. 4 preferably comprises several (e.g., two) discrete ejectors 23 which are distributed in such a way that upward movement of the lower ejector 23 simultaneously or slightly ahead of the upward and rightward movement of the left-hand ejector 23 invariably causes a freshly finished workpiece to roll over the upper right-hand rotary element 10 and onto the chute 6, not shown in FIG. 4. The number of ejectors 23 can be increased still further; for example, a third horizontally reciprocable ejector can be installed at a level above the upper left-hand rotary confining element 10 to perform a rightward stroke in response to lifting of the holders 9 and to thus even further ensure the transfer of a finished workpiece from the station 5, preferably in automatic response to lifting of the holders 9.

It often suffices if only one of the two holders 9 of FIG. 4 is positively driven by a motor or the like. In such apparatus, the other holder 9 is rotated by the workpiece 2 at the station 5, i.e., such workpiece can rotate the other holder 9 as well as all of the rotary confining elements 10.

An entire battery of knives 14 is shown in FIG. 7 wherein an elongated tubular workpiece or body 16 is to be subdivided into discrete tubular sections 15' of identical or different length, depending on the mutual spacing of the knives 14. FIG. 7 further shows two ring-shaped holders 17 for sets of piercing tools 8 which are mounted on a common shaft 18 adapted to be driven about its own axis (arrow 18*a*) as well as to move in the directions indicated by the arrow Pf1 in order to allow for axial shifting of the tubular body 16 at desired intervals. The apparatus of FIG. 7 is designed primarily for the making of sections 15', i.e., the perforating operation which is performed by the piercing tools 8 on the holders 17 is of secondary importance. The distance between the two sets of piercing tools 8 (on the holders 17 of FIG. 7) can be selected in such a way that the piercing tools actually sever the tubular body 16 in response to repeated penetration into contiguous selected portions of the wall of the body 16 (such contiguous selected portions then extend circumferentially around the entire body 16) so that the body 16 yields two additional tubular sections 15'', one between the leftmost knife 14 and the left-hand set of tools 8 and the other between the rightmost knife 14 and the right-hand set of tools 8.

It is assumed that the apparatus of FIG. 7 is designed primarily for subdivision of the tubular body 16 into sections 15' and that the tools 8 on the holders 17 serve to provide selected portions of selected sections 15' with annuli of perforations each having an outline corresponding to the profile of the respective tool. Each of the tools 8 is caused to repeatedly penetrate into one and the same portion of the wall of the tubular body 16, namely, once during each revolution of the shaft 18 which forms part of the drive means for the holders 17.

The rotary confining and locating elements for the sections 15' of the tubular body 16 have been omitted in FIG. 7 for the sake of clarity. If desired, the apparatus of FIG. 7 can be operated in the following manner: the shaft 18 is held in raised position (i.e., the holders 17 are lifted above and away from their operative positions) while the non-illustrated confining elements rotate the tubular body 16 and the knives 14 are caused to gradually penetrate into the wall of the rotating body 16 to form a group of coaxial sections 15'. The knives 14 are thereupon lifted above and away from the sections 15' therebelow, and the shaft 18 is lowered and is caused to rotate so that the piercing tools 8 form perforations in the two adjacent sections 15'. The tubular body 16 and its sections 15' are thereupon shifted axially to place two different sections 15' into register with the holders 17 (which are lifted during axial shifting of the body 16) and the holders 17 are thereupon lowered so that the tools 8 can pierce two different sections 15'. The procedure is repeated until a fresh (undivided) part of the tubular body 16 is moved into the space below the knives 14 which thereupon descend to separate a fresh group of sections 15' from the body 16 while the holders 17 are held in inoperative positions. The same sequence of steps is thereupon repeated again and again. It will be noted that the apparatus a portion of which is shown in FIG. 7 is highly versatile in that it can perform a severing operation simultaneously with an often desirable perforating action, only a severing operation, or a perforating operation upon selected portions of the tubular body 16 without resort to the knives 14, i.e., without subdivision of the body 16 into sections 15' of identical or different axial length.

If the piercing tools 8 on the holders 17 of FIG. 7 merely serve to rotate the tubular body 16, their tips need not penetrate all the way through the wall of the body 16, i.e., it then suffices to move the drive shaft 18 to a level at which the tips of the tools 8 can reliably rotate the body 16 while the cutting edges of the knives 14 penetrate into the wall of such body. As described in connection with FIG. 3, the cutting edges of the knives 14 shown in FIG. 7 can be staggered so that successive cutting edges begin to sever the wall of the body 16 at timely spaced intervals.

As already mentioned above, the apparatus which embodies the structure of FIG. 7 can be provided with rotary confining and locating elements which position the tubular body 16 at the severing station during penetration of cutting edges of the knives 14 into the wall of the rotating body. The rotary confining elements can be driven, especially if the tools 8 are not to be used as a means for rotating the body 16 during the making of tubular sections 15'.

The number of holders 17 will depend on the dimensions of the tubular body 16. If such body has a large diameter and the material of its wall offers a rather pronounced resistance to severing by the cutting edges of the knives 14, the apparatus of FIG. 7 will preferably employ a relatively large number of holders 17 which are spaced apart from one another, as considered in the axial direction of the shaft 18, so as to ensure that the body 16 will rotate about its own axis at a speed which is proportional to the speed of the drive shaft 18 while the cutting edges of the knives 14 form discrete sections 15'. Two or more shafts 18, each carrying one or more holders 17 for sets of piercing tools 8, can be placed adjacent to the severing or perforating station. This has been described with reference to FIG. 4. The provision of two or more shafts 18, each with one or more holders 17 for sets of piercing tools 8, is advisable or even necessary if the diameter of the tubular body 16 is large and if the material of the wall of such body cannot be readily pierced by needles, pins or the like and cannot be readily severed by the cutting edges of the knives 14 or analogous severing devices.

Figure 5:
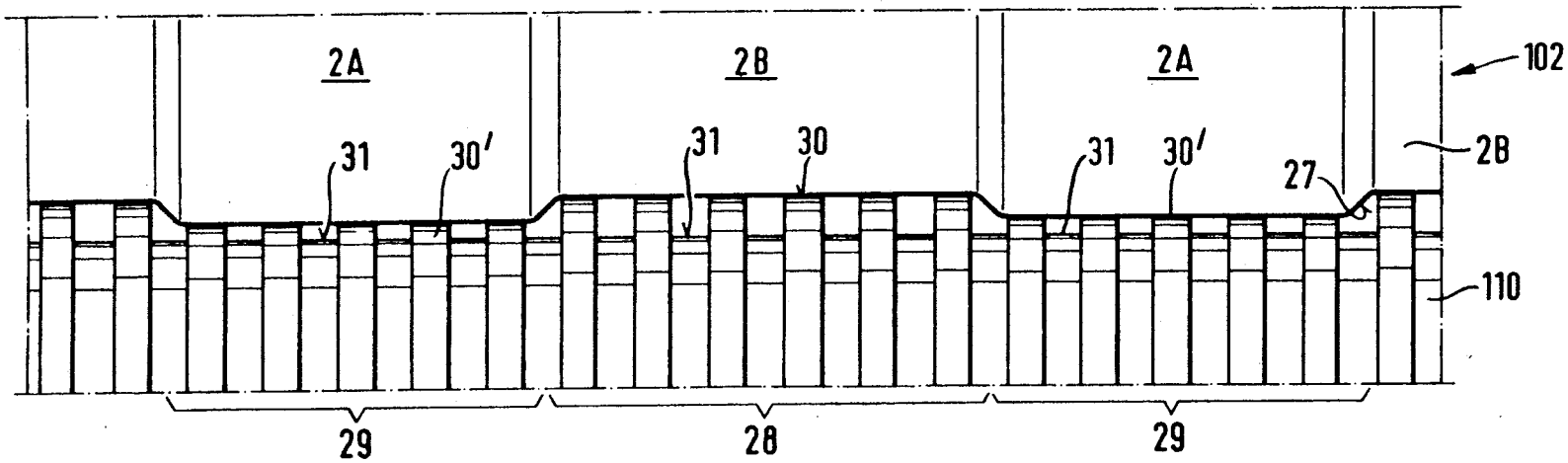
FIG. 5 is a fragmentary elevational view of a rotary locating and confining element for a workpiece wherein larger-diameter sections alternate with smaller-diameter sections.
Figure 11:
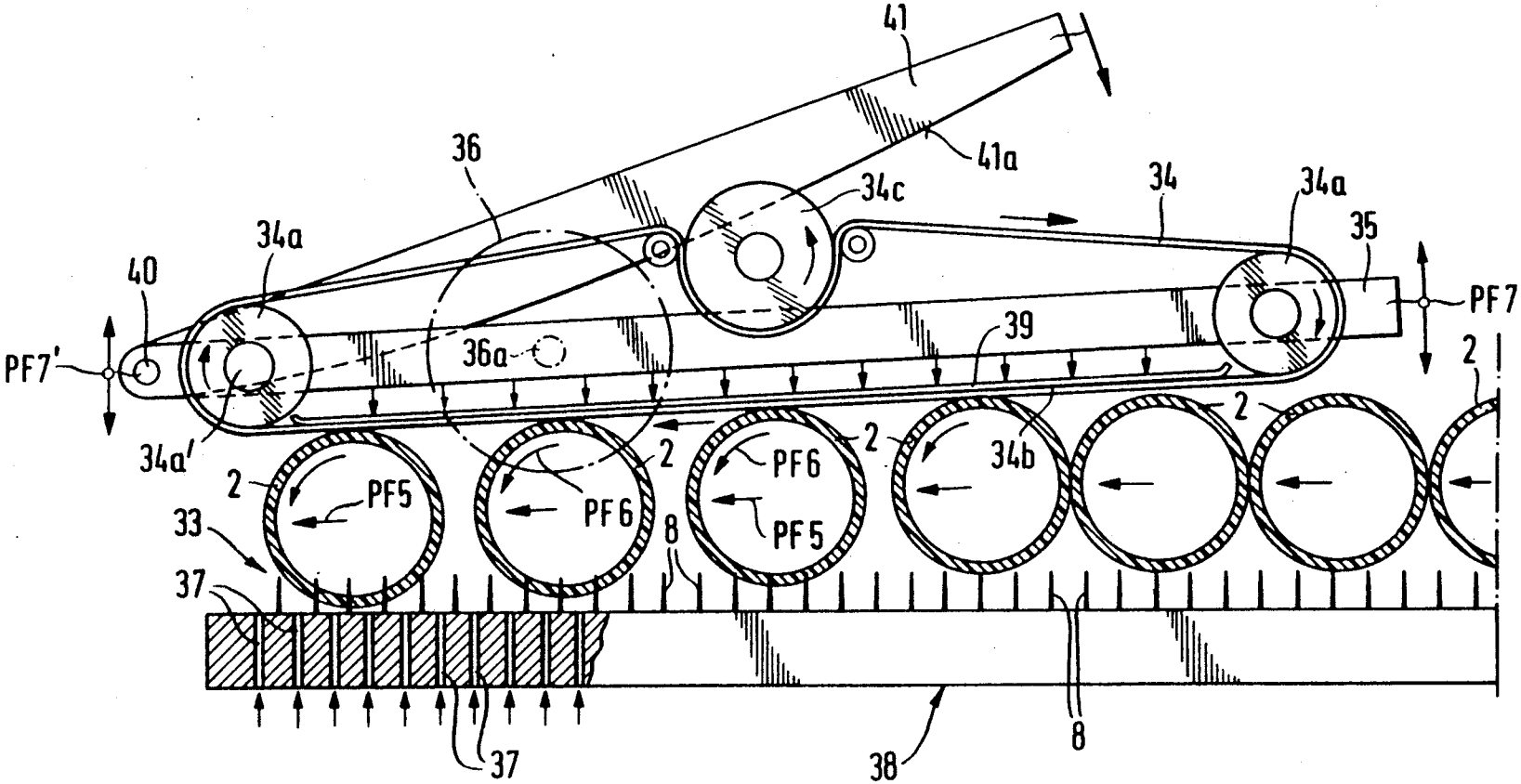
FIG. 11 is a fragmentary partly elevational and partly vertical sectional view of a fourth apparatus with a stationary holder for piercing tools.

Referring now to FIG. 5 there is shown a portion of a tubular workpiece 102 which is somewhat similar to the bobbin shown in FIG. 11 of the aforementioned U.S. Pat. No. 4,109,396 to Engel. FIG. 5 further shows a rotary confining element 110 whose profile is complementary to that of the workpiece 102. Thus, larger-diameter portions 28 of the rotary element 110 alternate with smaller-diameter portions 29. The workpiece 102 of FIG. 5 has alternating larger- and smaller-diameter sections 2A and 2B, and the neighboring sections flank frustoconical intermediate sections 27.

Each of the portions 28 includes larger-diameter annuli 30 alternating with smaller-diameter annuli 31, and each of the portions 29 includes larger-diameter annuli 30' alternating with smaller-diameter rings 31. The diameters of the annuli 30 exceed those of the annuli 30' to an extent which corresponds to the difference between the outer diameter of a section 2A and the outer diameter of a section 2B. This ensures that rotary confining elements 110 of the type shown in FIG. 5 can accurately position a workpiece 102 at the treating station and can hold such workpiece against axial movement.

Figure 6:
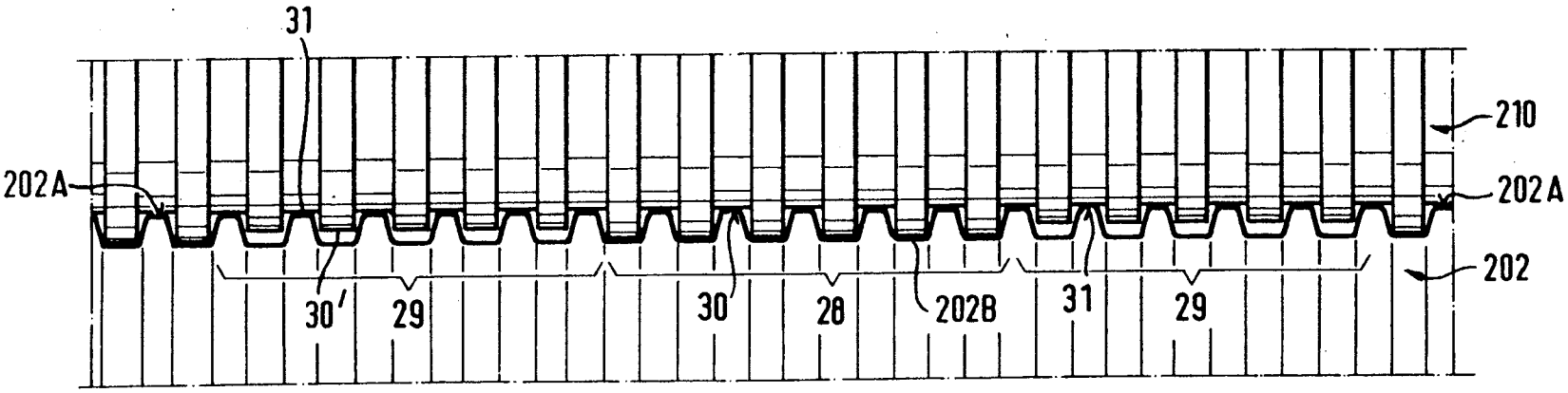
FIG. 6 is a similar fragmentary elevational view of a modified locating and confining element for a workpiece whose wall has an undulate cross-sectional outline.

FIG. 6 shows a portion of a workpiece 202 in an axial sectional view. The wall of the workpiece 202 is corrugated or undulate so that its external surface exhibits annular ribs 202A alternating with annular valleys 202B. The configuration of the rotary confining element 210 of FIG. 6 is identical to that of the rotary element 110 shown in FIG. 5; nevertheless, the element 210 of FIG. 6 can properly locate the workpiece 202 because the larger-diameter annuli 30 extend all the way into the adjacent valleys 202B whereas the larger-diameter annuli 30' do not actually contact the cylindrical surfaces in the deepmost regions of the respective valleys 202B.

Another advantage of holders 110 and 210 of the type shown in FIGS. 5 and 6 is that they can compensate for at least some inaccuracies in the configuration of the workpieces 102 or 202. For example, if a workpiece 102 or 202 is not straight, it is straightened out between rotary confining elements of the type shown in FIGS. 5 and 6 so as to ensure that the piercing tools of one or more holders will perforate selected portions of the workpiece 102 or 202. Also, the annuli 30 and 30' can effect at least some axial expansion or contraction of a workpiece 102 or 202, again for the purpose of ensuring that the piercing tools will perforate selected (predetermined) portions of the workpiece.

Utilization of workpieces 202 with a tubular wall having an undulate cross-sectional outline is desirable and advantageous when the workpieces are to yield axially or radially and axially. As mentioned above, rotary confining elements 210 of the type shown in FIG. 6 then ensure that the workpiece 202 is properly positioned and held at the treating station, i.e., that the perforations are invariably provided in selected portions of the wall of a workpiece 202 at such station. The provision of annuli 30' which do not penetrate all the way into the adjacent annular valleys 202B allows for some deformation of the workpiece 202 during engagement with the adjacent rotary confining element 210 so that the workpiece assumes an optimum shape for the making of perforations in its wall. The annuli 30' allow the workpiece 202 some freedom of movement in the radial as well as in the axial direction.

FIG. 11 shows a further apparatus wherein the holder 38 for the piercing tools 8 is stationary and has ports 37 for admission of a gaseous or liquid coolant which can regulate the temperature of the tools, e.g., prior to start of a perforating operation. A succession of discrete tubular workpieces 2 in the form of bobbins or other types of tubular commodities is caused to advance in the direction of arrows Pf5, and at least some of the workpieces 2 are simultaneously caused to rotate about their respective axes (note the arrows Pf6). The path of the illustrated series of workpieces 2, which move sideways (i.e., at right angles to their respective axes) extends above the stationary holder 38 and sufficiently close to the upper side of this holder to ensure that the workpieces 2 are adequately contacted by the tips of the piercing tools 8. The piercing tools 8 together form a preferably flat horizontal carding 33 which is disposed at the upper side of the stationary holder 38 and the tips of all piercing tools are preferably disposed in a common plane. The means for effecting repeated penetration of piercing tools 8 into selected portions of successive workpieces 2 comprises one or more endless belt or chain conveyors 34 trained over pulleys **34*a* which are mounted on one or more one-armed levers 35. Each such lever is pivotable about a horizontal axis which is defined by a fulcrum 40 in the frame of the apparatus embodying the structure of FIG. 11. The inclination of the work-engaging lower reach 34*b* of the conveyor 34 is such that it causes successive workpieces 2 to move nearer to the upper side of the holder 38, i.e., that the extent of penetration of the tools 8 into successive workpieces 2 increases in a direction from the right to the left, as viewed in FIG. 11. The inclination of the lower reach 34*b* of the conveyor 34 can be altered by changing the inclination of the lever or levers 35 in one of the directions indicated by a double-headed arrow Pf7. The arrow Pf7' indicates the directions in which the entire lever or levers 35 (together with the fulcrum or fulcra 40) can be moved nearer to or further away from the carding 33 in order to enable the apparatus of FIG. 11 to treat larger- or smaller-diameter tubular workpieces. A tensioning roll 34*c* is mounted on the lever or levers 35 to ensure that the lower reach 34*b* is in adequate frictional engagement with the series of workpieces 2 on the holder 38. The tensioning roll 34*c* is preferably adjustable relative to the lever or levers 35 to thus ensure that the extent of frictional engagement between the underside of the lower reach 34*b* and the peripheral surfaces of the workpieces 2 can be regulated within a desired range. The material of the conveyor 34 (and/or the finish of its outer side) can be selected with a view to promote friction with the material of the workpieces 2. The lever or levers 35 can be moved to and locked in any one of a large number of different positions, and the tension of the conveyor 34 must suffice to ensure predictable lowering of successive workpieces 2 as they advance from the right-hand end toward the left-hand end of the carding 33**.

The lever or levers 35 further carry one or more knives 36 (one disc-shaped rotary circular knife is shown in FIG. 11 by phantom lines) if each of the workpieces 2 is to be subdivided into two or more discrete sections (corresponding to the sections **15*a* to 15*c* shown in FIG. 2) during travel along the upper side of the holder 38. The axis of the fulcrum or fulcra 40 is preferably parallel to the plane of the upper side of the holder 38, and such axis is preferably also parallel to the axes of the workpieces 2** on the holder.

The illustrated carding 33 can constitute one of two or more cardings at the upper side of the holder 38 or at the upper sides of two or more discrete holders which are disposed one behind the other, as viewed in FIG. 11. The number of discrete cardings depends on the number of selected portions which are to be perforated on each of the workpieces 2 and/or whether or not the selected perforated portions should be separated from one another by annular portions which are devoid of perforations.

The conveyor 34 is driven by a drive means including one of the pulleys **34*a* and its shaft 34*a'* so that the lower reach 34*b* advances in the direction indicated by the arrows Pf5. This ensures that at least some of the workpieces 2 are compelled to rotate in response to engagement by the lower reach 34*b* simultaneously with engagement by the tools 8 therebelow. FIG. 11 shows that the lower reach 34*b* of the conveyor 34 positively rotates the four left-hand workpieces 2 while the remaining three workpieces merely advance in the direction indicated by the arrows Pf5 but need not necessarily rotate about their respective axes. If desired, the outer side of the conveyor 34 can also carry pins, needles or otherwise configurated protuberances to further reduce the likelihood of slippage of the lower reach 34*b* relative to the adjacent workpieces 2 (namely, those workpieces which are in actual contact with the underside of the lower reach 34*b***).

The rotary circular knife 36 (whose shaft **36*a* can receive motion from the driven pulley 34*a*, e.g., through the medium of a gear train, not shown, connecting the shafts 34*a'* and 36*a*) can be replaced by or used in addition to a manually or otherwise pivotable knife 41. The illustrated knife 41 has an elongated cutting edge 41*a* and is pivotable about the axis which is defined by the fulcrum or fulcra 40 for the lever or levers 35. The knife 41 can be operated by the attendant when the need arises to divide a selected workpiece 2 into two or more sections. This knife 41 can constitute one of a battery of knives which are disposed one behind the other, as viewed in FIG. 11**.

FIG. 11 further shows a back support 39 in the form of an elongated rail which is preferably adjustably mounted on the lever or levers 35 and prevents the work-engaging lower portion or reach **34*b* of the conveyor 34 from yielding in response to engagement with the peripheral surfaces of successive workpieces 2 which roll along the carding 33**.

Referring finally to FIGS. 12 and 13, there is shown a portion of a further apparatus which is designed to make perforations in an elongated axially movable tubular workpiece or body 2''. The direction of intermittent or continuous axial movement of this body is indicated by the arrow Pf4. The apparatus comprises at least one but preferably several (e.g., twelve) rotary holders 32 for sets of piercing tools 8. In the embodiment of FIGS. 12 and 13, the holders 32 form four groups or arrays of three holders each, and the planes of such arrays extend radially of the tubular body 2''. The axes of the holders 32 are normal to the axis of the body 2'', the axes of holders 32 in each array of three holders are parallel to each other, and the axes of holders 32 in the neighboring arrays of such holders make angles of 90° with one another. However, and as shown in FIG. 13 by phantom lines, one or more arrays of holders 32, or one or more discrete holders 32, can be moved to different positions, depending on the location of those selected portions of the tubular body 2'' which should be perforated by the tools 8 while the body 2'' advances in the direction of arrow Pf4. The tools 8 can advance the tubular body 2 or the latter can rotate the holders 32 in response to axial movement in the direction of arrow Pf4. The distribution of tools 8 on the holders 32 of each array is preferably such that the tools 8 of a next-following holder 32 (as considered in the direction of arrow Pf4) penetrate into the perforations which are formed by the tools 8 of the preceding holder or holders 32 in the same array.

If some or all of the holders 32 are disposed in planes which do not include the axis of the tubular body 2'', the corresponding tools 8 can provide the body 2'' with perforations which form one or more spirals in the wall of the finished product. For example, the three median holders 32' of FIG. 12 can be mounted in planes which are slightly inclined with reference to a horizontal planes so that their tools 8 then provide the corresponding portions of the tubular body 2'' with helically extending perforations.

The tubular body 2'' which is shown in FIGS. 12 and 13 can issue directly from an extruding or like machine.

The apparatus of FIGS. 12 and 13 can be further modified, or rendered even more versatile, by the provision of one or more additional rotary holders of the type shown in FIGS. 3 and 4, i.e., by the provision of additional holders whose axes of rotation are parallel to the axis of the tubular body 2''. The sets of piercing tools on such additional holders can be used to make perforations in selected portions of the body 2'', e.g., during the intervals of idleness of the illustrated holders 32. The just discussed additional holder or holders can be provided in addition to the holders 32, 32' and/or in addition to the aforediscussed holders which can be used to provide the tubular body 2'' with one or more series of helically distributed perforations.

It will be noted that the holders 32 in the upper and lower arrays of FIG. 12 are disposed at different distances from the periphery of the tubular body 2'' which moves axially in the direction of arrow Pf4. This renders it possible to effect less pronounced penetration of tools 8 on the rightmost holders 32, more pronounced penetration of tools 8 on the median holders 32, and maximum penetration of tools 8 on the leftmost holders 32 in the respective arrays. Moreover, the shiftability of holders 32 and/or 32' radially of the tubular body 2'' (the shifting means is not specifically shown but can include a pivotable lever for each of the arrays of holders 32 or 32') renders it possible to convert the apparatus of FIGS. 12 and 13 for the treatment of larger- or smaller-diameter workpieces having any one of a wide variety of different profiles including profiles of the type shown in FIG. 5 or 6.

An advantage which is common to the apparatus of FIGS. 1–3, 4, 7 and 12–13 is that there is no need to provide a separate drive for the workpiece and/or for the rotary locating and confining elements. Thus, the tools 8 act not unlike the teeth of a gear to "mesh" with the wall of the workpiece and to move the latter axially and/or to rotate the workpiece about its own axis in the course of the perforating and/or severing operation. This contributes significantly to compactness, lower cost and simplicity of the apparatus which employ one or more rotary holders for piercing tools. Moreover, such mode of rotating and/or axially moving the workpiece is even more likely to ensure that selected portions of the workpiece at the treating station are repeatedly pierced by one and the same tool or by different tools with the aforediscussed advantages as concerns predictability of ultimate configuration and dimensions of the perforations and heating of the piercing tools. Excessive heating of the tools can be avoided by resort to the aforediscussed temperature regulating means and/or by utilizing a variable-speed motor for the means which effects repeated penetration of the tools into selected portions of the workpiece. The same undertaking can be resorted to if the heating of tools during the making of perforations is insufficient, i.e., the speed of the means for effecting repeated penetration of the tools can be increased with attendant increase in the frequency of penetration of each tool into the material of the workpiece during treatment of a workpiece at the treating station.

If the improved apparatus is used for the making of perforations, the dimensions of the perforations will depend on several parameters, primarily on the number of penetrations of one and the same tool or of different tools into a selected portion of the workpiece and also on the extent to which the tools are heated as a result of repeated penetration into the material of the workpiece.

If the improved apparatus is used for the making of perforations in and/or for severing sections from a continuous tubular body or from discrete tubular bodies (e.g., for separating end walls from blow molded bottles or like hollow articles), the severing of sections can be effected by piercing tools or by one or more discrete knives which sever the tubular bodies prior to or simultaneously with the making of perforations in selected portions of some or all of the sections. As explained in connection with FIGS. 1 to 3, it is particularly advantageous to sever a tubular body by resorting to one or more knives if the tubular body rotates while dwelling at the treating station. This ensures the making of clean cuts and avoids the need for a separate severing operation at a time which precedes or follows the making of perforations. As also mentioned above, the rotary holder or holders and their piercing tools can be used solely to rotate the tubular body; in such apparatus, the piercing tools need not penetrate through the wall of the tubular body but merely penetrate into or otherwise engage the wall of the tubular body to the extent which is needed in order to ensure a predictable angular and/or axial movement of the tubular body in the course of the severing operation.

It is further within the purview of the invention to omit or remove the holder or holders for the piercing tools if the apparatus is designed (or is used at certain times) exclusively for the subdivision of a relatively long or continuous tubular body into sections of preselected axial length. In such apparatus, the tubular body is preferably, but need not necessarily be, rotated and/or otherwise moved by one or more holders of piercing tools. For example, and referring again to FIG. 3, if the apparatus 1 is to be temporarily or permanently converted for the subdivision of workpieces 2 into articles 15 each of which includes three unperforated sections 15*a* to 15*c*, and if the workpiece 2 at the station 5 is rotated by a separate drive or by the rotary confining elements 10, the holder 9 can be detached from the lever or levers 11 which then merely support the knife or knives 14 and are pivotable to move the cutting edge or edges 26 into severing engagement with the workpiece which rotates at the station 5.

The rotary holder or holders for one or more sets of piercing tools 8 can be retained even if the apparatus is used primarily or exclusively to sever sections of preselected length from a continuous tubular body or from tubular bodies of finite length. For example, and referring again to FIG. 3, the holder 9 can be retained even if the workpiece 2 at the station 5 need not be perforated and even if the workpiece is rotated by its own drive and/or by a drive 10*c* for one or more rotary confining elements 10. In such apparatus, the holder 9 merely rotates in response to rotation of the workpiece 2 at the station 5 and its tools 8 ensure that the rotary elements 10 cannot slip relative to the workpiece because the tools urge the peripheral surface of the workpiece against the elements 10.

The operation of the improved apparatus can be automatic or semiautomatic. For example, all of the operations other than the step of rotating various rotary components can be performed by hand. Alternatively, the apparatus can be provided with detector means in the form of mechanical sensors, photocells and/or others which generate signals upon completion of certain operations and/or upon completion of certain movements and/or after elapse of preselected intervals of time to trigger successive operations so that the apparatus will automatically turn out desired numbers of perforated and/or slitted articles per unit of time.

Irrespective of the extent of its automation, the improved apparatus exhibits a number of important advantages. Thus, there is no need to preheat or heat the piercing tools prior to or in the course of a perforating and/or severing operation. This brings about substantial savings in energy, reduces the likelihood of danger and injury, and contributes to compactness and simplicity of the apparatus.

Another important advantage of the improved apparatus is that it can make perforations and/or incisions without the formation of any or with the formation of negligible quantities of scrap which could contaminate the apparatus and could also interfere with predictable perforation of next-following workpieces. Moreover, the absence of scrap is equally important and advantageous when the finished workpieces are bobbins which are used for the purposes and in a manner as disclosed, for example, in the aforementioned patent to Engel, i.e., the scrap (remnants of removed material of the workpieces) cannot contaminate the machines wherein the finished products are put to use. The development of scrap is unavoidable if the perforations are made by punching.

An additional important advantage of the improved apparatus is that the workpieces which are being treated at the perforating and/or severing station, the workpieces which are in the process of being delivered to such station and/or the workpieces which are transported away from the station need not be supported from within, e.g., by spindles, mandrels or analogous parts which contribute to the bulk and cost of the apparatus and reduce the output. In spite of the absence of internal supporting or propping means, the aforedescribed locating elements can position the workpieces with a very high degree of accuracy so that the apparatus can turn out long or short series of finished products wherein the perforations and/or slits and/or cuts are distributed and/or made in exact accordance with a predetermined pattern.

In view of its simplicity and compactness, the improved apparatus can be placed into immediate or close proximity of the machine or machines which turn out the workpieces so that the workpieces can be finished in the plant where they are produced and can be shipped or delivered directly to the locus of actual use.

Another important advantage of the improved apparatus is its versatility. Thus, the apparatus can treat continuous or discontinuous, large-diameter or small-diameter, axially moving or rotary workpieces with the same facility and accuracy. Also, the apparatus can be readily converted from the treatment of a first type of workpieces to the treatment of other types of workpieces with minimal losses in time for the changes of setup.

Instead of using the tools 8 as a means for actually severing the workpiece or as a means for making perforations in the wall of the workpiece, these tools can also serve as a means for partially severing a workpiece, e.g., for making perforations close to one another in a plane which is normal to the axis of a tubular workpiece so that the workpiece can be broken up into discrete tubular sections with a minimum of effort by destroying the webs between the closely adjacent perforations. Analogous rows of closely adjacent perforations can be made in parallelism with the axis of the workpiece if the latter is to be subdivided into two or more elongated trough-shaped bodies.

As mentioned above, the apparatus of the present invention can be converted into an apparatus which serves to subdivide workpieces into tubular sections by resort to one or more knives, such as the knives 14. However, even if the apparatus is used exclusively for severing with resort to knives, the perforating tools 8 can perform a novel and useful function by rotating the workpiece in the course of the severing operation, i.e., the extent of engagement between the tools 8 and the workpiece is then selected in such a way that the tools need not penetrate through the wall of the workpiece but do engage the workpiece with a sufficient force to ensure rotation and/or axial movement of the workpiece at a speed which is directly related to the speed of the holder or holders for the tools.

At least in many instances, the improved method and apparatus can be used with advantage for the making of perforations in the form of elongated holes or slots.

At least some heating of piercing or perforating tools which are used to make perforations in workpieces consisting of or containing a synthetic thermoplastic material is desirable and advantageous for a number of reasons. Thus, a heated tool is more likely to penetrate into and to be readily withdrawable from the wall of a thermoplastic tube or the like. An overheating of the tools should be avoided in order to ensure that the surfaces bounding the perforations are devoid of burrs and other unevennesses.

If a piercing tool is to make a permanent perforation or hole in a synthetic plastic workpiece in accordance with heretofore known techniques, the tool must be preheated with attendant cost for heating equipment and regulation of the heating action. This is avoided, in accordance with the invention, by the novel expedient of heating the tools as a result of repeated penetration into and frictional engagement with the material of the workpiece. A conventional perforating operation with resort to preheated tools is analogous to welding. Also, the conventional techniques of preheating the tools for single penetration into a workpiece are unsatisfactory when the material of the workpiece is relatively soft and yieldable so that a single contact with a pointed tool is not likely to result in the making of a perforation but rather in a deflection of the respective portion of the soft workpiece. Such deflection is much less likely if the perforating tools are caused to repeatedly engage selected portions of a workpiece, even if the workpiece is made of a very soft and therefore highly yieldable material. It has been found that the improved method and apparatus are highly suited for the treatment of nonelastic workpieces, e.g., workpieces consisting of duroplastic material. Repeated penetration of the tools into such material and the resultant heating of the tools ensures desirable displacement of the material for the making of predictable holes in the form of elongated slots or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making perforations in the walls of tubular workpieces such as synthetic plastic bobbins for textile yarns or the like, comprising the steps of effecting an initial penetration of selected portions of the wall of at least one tubular workpiece using at least one piercing tool; repeating said penetration effecting step for each of said selected portions; regulating the penetration frequency and total number of penetrations of the tool so that said frequency and number are sufficiently high to measurably raise the temperature of the tool due to friction generated during penetration and extraction of the latter, and so that a perforation is progressively formed at each of said selected portions; and confining the workpiece against movement in at least one of the directions including axially and radially of the workpiece so as to ensure that the at least one piercing tool repeatedly penetrates into the selected portions of the workpiece.

2. The method of claim 1, wherein at least some selected portions of the workpiece are contiguous so that the perforations in their totality form at least one incision through the wall of the workpiece.

3. The method of claim 1, comprising the step of rotating the workpiece about it axis in the course of said penetration effecting steps.

4. The method of claim 3, comprising the step of orbiting the tool about a second axis so that the tool penetrates into the workpiece once during each of its orbits, said orbiting step taking place simultaneously with said rotating and penetration effecting steps.

5. The method of claim 4, wherein the circle which is described by the tip of the piercing tool in the course of said orbiting step intersects the periphery of the rotating workpiece.

6. The method of claim 4, wherein said rotating step comprises rotating the workpiece in a first direction and said orbiting step comprises orbiting the piercing tool in a second direction counter to the first direction.

7. The method of claim 4, further comprising the step of orbiting at least one additional piercing tool about a third axis so that the additional tool penetrates into the wall of the rotating workpiece once during each of its orbits, the orbiting of said additional tool taking place in the course of said penetration effecting steps.

8. The method of claim 4, wherein the second axis is at least substantially parallel to the axis of the rotating workpiece.

9. The method of claim 1, comprising the step of orbiting the tool about a predetermined axis in the course of said penetration effecting steps so that the tool penetrates into the wall of the workpiece once during each of its orbits and the workpiece is rotated about its own axis as a result of repeated penetration of its wall by the tool.

10. The method of claim 1, further comprising the step of regulating the temperature of the tool in the course of said penetration effecting steps.

11. The method of claim 10, wherein said temperature regulating step comprises contacting the tool with a gaseous fluid.

12. The method of claim 10, wherein said temperature regulating step comprises cooling the tool while the tool is out of contact with the workpiece.

13. The method of claim 12, wherein said temperature regulating step comprises contacting the tool with a liquid coolant.

14. The method of claim 13, wherein said contacting step comprises atomizing the coolant and spraying the atomized coolant onto the tool.

15. The method of claim 13, wherein the coolant is a lubricant and said contacting step comprises establishing an exchange of heat between the tool and droplets of such lubricant.

16. The method of claim 13, wherein said contacting step comprises brushing droplets of coolant onto the tool while the tool is out of contact with the workpiece.

17. The method of claim 1, wherein the workpiece forms part of an elongated tubular body and said selected portions are contiguous and extend circumferentially of the tubular body so that the perforations in their entirety form a circumferentially complete incision in the elongated body.

18. The method of claim 17, comprising the step of rotating the elongated body about its own axis in the course of said penetration effecting steps.

19. The method of claim 18, wherein said penetration effecting steps comprise perforating additional portions of the elongated body other than said contiguous portions.

20. The method of claim 1, wherein the tool is needle-shaped.

21. Apparatus for making perforations in the walls of tubular workpieces such as synthetic plastic bobbins for textile yarns or the like, comprising perforating means including at least one piercing too; means for effecting repeated penetration of selected portions of a workpiece by said perforating means such that the perforation frequency and total number of penetrations of said tool are sufficiently high to measurably raise the temperature of said tool due to friction generated during penetration and extraction of the latter, and such that a perforation is progressively formed at each of the selected portions, said penetration effecting means including means for confining the workpiece against movement in at least one of the directions including axially and radially of the workpiece so as to ensure that the piercing tool repeatedly penetrates into and is repeatedly extracted from the selected portions of the workpiece, said confining means comprising a plurality of rotary confining elements defining for the workpiece a treating station; and means for severing the workpiece at said station in at least one plane which is at least substantially normal to the axis of such workpiece.

22. The apparatus of claim 21, wherein at least one of said rotary elements comprises at least two spaced apart coaxial portions and said severing means comprises a knife which is disposed between such portions of said one rotary element.

23. The apparatus of claim 21, wherein said severing means comprises at least one knife.

24. The apparatus of claim 21, wherein said severing means comprises a plurality of knives spaced apart from one another, as considered in the axial direction of the workpiece at said station, said holder including a rotor which is arranged to rotate the workpiece at said station through the medium of said piercing tools.

25. Apparatus for making perforations in the walls of tubular workpieces such as synthetic plastic bobbins for textile yarns or the like, comprising perforating means including at least one piercing tool; means for effecting repeated penetration of selected portions of a workpiece by said perforating means such that the perforation frequency and total number of penetrations of said tool are sufficiently high to measurably raise the temperature of said tool due to friction generated during penetration and extraction of the latter, and such that a perforation is progressively formed at each of the selected portions, said penetration effecting means including means for confining the workpiece against movement in at least one of the directions including axially and radially of the workpiece so as to ensure that the piercing tool repeatedly penetrates into and is repeatedly extracted from the selected portions of the workpiece; and means for regulating the temperature of said piercing tool.

26. The apparatus of claim 25, wherein said regulating means includes means for directing a fluid against the piercing tool.

27. The apparatus of claim 26, wherein said perforating means comprises a rotary holder and a set of piercing tools on said holder, said fluid directing means including a channel extending in parallelism with said holder and having at least one orifice arranged to discharge the fluid against the piercing tools while said holder rotates about its axis.

28. The apparatus of claim 26, wherein the fluid is a gas.

29. The apparatus of claim 26, wherein the fluid is a liquid.

30. The apparatus of claim 25, wherein said perforating means comprises at least one rotary holder and a set of piercing tools on said holder, said regulating means including a brush extending in substantial parallelism with said holder and having bristles arranged to contact the piercing tools with a liquid coolant in response to rotation of said holder about its axis.

31. The apparatus of claim 30, wherein the bristles of said brush are arranged to engage at least the tips of successive tools while said holder rotates about its axis.

32. Apparatus for making perforations in the walls of tubular workpieces such as synthetic plastic bobbins for textile yarns or the like, comprising perforating means including at least one rotary holder and a set of piercing tools on said holder; means for effecting repeated penetration of selected portions of a workpiece by said perforating means such that the perforation frequency and total number of penetrations of said tools are sufficiently high to measurably raise the temperature of said tools due to friction generated during penetration and extraction of the latter, and such that a perforation is progressively formed at each of the selected portions, said penetration effecting means including means for confining the workpiece against movement in at least one of the directions including axially and radially of the workpiece so as to ensure that each piercing tool repeatedly penetrates into and is repeatedly extracted from a selected portion of the workpiece; means defining a treating station for the workpieces; means for moving said holder to and from an operative position in which the tools of said holder penetrate into the workpiece at said station, including a member which is pivotable about a predetermined axis; at least one ejector arranged to expel the workpiece from said station while said holder is out of said operative position, said holder and said ejector being disposed at opposite sides of the workpiece at said station and said ejector being movable into and from said station; and means for moving said ejector into said station to thereby expel the workpiece from such station in response to movement of said holder from said operative position, said holder being mounted on said member and said means for moving said ejector comprising a device which receives motion from said member.

33. Apparatus for making perforations in the walls of tubular workpieces such as synthetic plastic bobbins for textile yarns or the like, comprising perforating means including at least one piercing tool; means for effecting repeated penetration of selected portions of a workpiece by said perforating means such that the perforation frequency and total number of penetrations of said tool are sufficiently high to measurably raise the temperature of said tool due to friction generated during penetration and extraction of the latter, and such that a perforation is progressively formed at each of the selected portions, said penetration effecting means including means for confining the workpiece against movement in at least one of the directions including axially and radially of the workpiece so as to ensure that the piercing tool repeatedly penetrates into and is repeatedly extracted from the selected portions of the workpiece; and at least one knife for severing the workpiece in a plane which is at least substantially normal to the axis of such workpiece, said knife having a cutting edge which is inclined with reference to a tangent at that locus of the peripheral surface of the workpiece where the cutting edge penetrates into the workpiece.

34. The apparatus of claim 33, wherein the cutting edge and said tangent make an acute angle.

35. The apparatus of claim 33, comprising means for rotating the workpiece about its axis in the course of the severing operation, and means for moving the knife toward and away from the rotating workpiece while the workpiece rotates about its axis

36. Apparatus for making perforations in the walls of tubular workpieces, such as synthetic plastic bobbins for textile yarns or the like, comprising perforating means including at least one piercing tool; means for effecting repeated penetration of selected portions of a workpiece by said perforating means such that the perforation frequency and total number of penetrations of said tool are sufficiently high to measurably raise the temperature of said tool due to friction generated during penetration and extraction of the latter, and such that a perforation is progressively formed at each of the selected portions, said penetration effecting means including means for confining the workpiece against movement in at least one of the directions including axially and radially of the workpiece so as to ensure that the piercing tool repeatedly penetrates into and is repeatedly extracted from the selected portions of the workpiece; means for rotating the workpiece about its axis; and a plurality of knives having cutting edges and being movable into engagement with the rotating workpiece so that the cutting edges subdivide the workpiece into a plurality of tubular sections, said cutting edges being staggered with reference to one another so that they being timely to sever the rotating workpiece at spaced intervals.

37. Apparatus for making perforations in the walls of profiled tubular workpieces having larger-diameter portions alternating with smaller-diameter portions, such as synthetic plastic bobbins for textile yarns and the like, comprising perforating means including at least one piercing tool; means for effecting repeated penetration of selected portions of a workpiece by said perforating means such that the perforation frequency and total number of penetrations of said tool are sufficiently high to measurably raise the temperature of said tool due to friction generated during penetration and extraction of the latter, and such that a perforation is progressively formed at each of the selected portions, said penetration effecting means including means for confining the workpiece against movement in at least one of the directions including axially and radially of the workpiece so as to ensure that the piercing tool repeatedly penetrates into and is repeatedly extracted from the selected portions of the workpiece; and rotary confining elements for the workpiece, said elements defining for the workpiece a treating station and being rotatable about axes which are at least substantially parallel to the axis of the workpiece at said station, at least one of said elements having a profile which is at least substantially complementary to the profile of the workpiece at said station, said at least one element including smaller-diameter annular portions and larger-diameter annular portions alternating with said smaller-diameter annular portions, said larger-diameter annular portions including first portions having larger diameters and second portions having smaller diameters.

38. Apparatus for making perforations in the walls of tubular workpieces such as synthetic plastic bobbins for textile yarns or the like, comprising perforating means including at least one piercing tool; means for effecting repeated penetration of selected portions of a workpiece by said perforating means such that the perforation frequency and total number of penetrations of said tool are sufficiently high to measurably raise the temperature of said tool due to friction generated during penetration of the latter, and such that a perforation is progressively formed at each of the selected portions, said penetration effecting means including means for confining the workpiece against movement in at least one of the directions including axially and radially of the workpiece so as to ensure that the piercing tool repeatedly penetrates into and is repeatedly extracted from the selected portions of the workpiece, said confining means defining for the workpiece a treating station; and at least one ejector for expelling a workpiece from said station upon completion of the perforating operation, said ejector comprising an elongated support extending substantially parallel with the tubular workpiece at said station and a deformable work-contacting member carried by said support and movable by the support into said station to thereby expel the workpiece from the station.

39. The apparatus of claim 38, wherein said work-contacting member consists at least in part of an elastomeric material.

40. The apparatus of claim 39, wherein said work-contacting member is hollow and includes a bight which is movable into engagement with the workpiece at said station.

41. The apparatus of claim 38, wherein said work-contacting member includes an elastically deformable portion which is arranged to engage and dislodge the workpiece from said station in response to movement of said member into such station.

42. Apparatus for making perforations in the walls of tubular workpieces such as synthetic plastic bobbins for textile yarns or the like, comprising perforating means having at least one holder and a plurality of piercing tools on said holder; means for effecting repeated penetration of selected portions of a workpiece by said perforating means such that the perforation frequency and total number of penetrations of said tools are sufficiently high to measurably raise the temperature of said tools due to friction generated during penetration and extraction of the latter, and such that a perforation is progressively formed at each of the selected portions, said penetration effecting means including means for confining the workpiece against movement in at least one of the directions including axially and radially of the workpiece so as to ensure that each piercing tool repeatedly penetrates into and is repeatedly extracted from a selected portion of the workpiece; and means for regulating the temperature of said tools, including ports provided in said holder and arranged to convey a fluid medium to said tools.

43. The apparatus of claim 42, wherein said fluid is a gaseous coolant.

44. The apparatus of claim 42, wherein said fluid is a liquid coolant.

* * * * *